US010767674B2

(12) United States Patent
Kai et al.

(10) Patent No.: US 10,767,674 B2
(45) Date of Patent: Sep. 8, 2020

(54) CONSTRUCTION MACHINE

(71) Applicant: Hitachi Construction Machinery Co., Ltd., Taito-ku, Tokyo (JP)

(72) Inventors: Takamasa Kai, Tokyo (JP); Hiromasa Takahashi, Tsuchiura (JP); Teppei Saitoh, Tokyo (JP); Juri Shimizu, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/472,943

(22) PCT Filed: Nov. 7, 2017

(86) PCT No.: PCT/JP2017/040101
§ 371 (c)(1),
(2) Date: Jun. 24, 2019

(87) PCT Pub. No.: WO2018/179563
PCT Pub. Date: Oct. 4, 2018

(65) Prior Publication Data

US 2019/0352884 A1 Nov. 21, 2019

(30) Foreign Application Priority Data

Mar. 27, 2017 (JP) ..... 2017-061341

(51) Int. Cl.
*F15B 21/08* (2006.01)
*E02F 9/22* (2006.01)
(Continued)

(52) U.S. Cl.
CPC ..... *F15B 21/087* (2013.01); *E02F 3/437* (2013.01); *E02F 9/2203* (2013.01);
(Continued)

(58) Field of Classification Search
CPC ..... F15B 2211/761; F15B 11/024; F15B 2011/0243; F15B 2011/0246; F15B 2211/88
(Continued)

(56) References Cited

U.S. PATENT DOCUMENTS 9,695,842 B2 * 7/2017 Akiyama ..... F15B 11/08
9,879,405 B2 * 1/2018 Saitoh ..... E02F 9/2289
(Continued)

FOREIGN PATENT DOCUMENTS

JP 2014-20431 A 2/2014
JP 2015-203453 A 11/2015

OTHER PUBLICATIONS

International Search Report (PCT/ISA/210) issued in PCT Application No. PCT/JP2017/040101 dated Feb. 6, 2018 with English translation (two (2) pages).
(Continued)

*Primary Examiner* — Abiy Teka
*Assistant Examiner* — Michael Quandt
(74) *Attorney, Agent, or Firm* — Crowell & Moring LLP

(57) ABSTRACT

A construction machine includes a bidirectionally tiltable type hydraulic pump 2, a hydraulic cylinder 1 having a cap chamber 1*e* and a rod chamber 1*f*, a first flow path 11 connecting the hydraulic pump 2 and the cap chamber 1*e*, a second flow path 12 connecting the hydraulic pump 2 and the rod chamber 1*f*, a discharge flow path 16 branched from the first flow path 11, a discharge valve 32 that is disposed in the discharge flow path 16 and controls a discharge rate of hydraulic working oil from the cap chamber 1*e* to the discharge flow path 16, an operation device 54 that instructs an action of the hydraulic cylinder 1, and a controller 56. The controller 56 controls the hydraulic pump 2 and the discharge valve 32 such that at least a part of hydraulic working
(Continued)

oil discharged from the cap chamber 1*e* is discharged to the discharge flow path 16 when an operation amount of the operation device 54 lies within a fine operation region during a pulling action of the hydraulic cylinder 1 in a state that a load is applied in a contraction direction. Accordingly, operability improves during fine operation of the pulling action of the hydraulic cylinder in the state that the load is applied in the contraction direction.

3 Claims, 15 Drawing Sheets

(51) Int. Cl.

| | |
|---|---|
| ***F15B 11/024*** | (2006.01) |
| ***F15B 11/044*** | (2006.01) |
| ***F15B 11/08*** | (2006.01) |
| ***F15B 7/00*** | (2006.01) |
| ***E02F 3/43*** | (2006.01) |
| *E02F 3/32* | (2006.01) |

(52) U.S. Cl.
CPC ..... *E02F 9/2217* (2013.01); *E02F 9/2225* (2013.01); *E02F 9/2289* (2013.01); *E02F 9/2296* (2013.01); *F15B 7/006* (2013.01); *F15B 11/024* (2013.01); *F15B 11/044* (2013.01); *F15B 11/08* (2013.01); *F15B 21/082* (2013.01); *E02F 3/32* (2013.01); *E02F 9/2292* (2013.01); *F15B 2211/20546* (2013.01); *F15B 2211/20561* (2013.01); *F15B 2211/20569* (2013.01); *F15B 2211/20576* (2013.01); *F15B 2211/27* (2013.01); *F15B 2211/3058* (2013.01); *F15B 2211/327* (2013.01); *F15B 2211/4159* (2013.01); *F15B 2211/41581* (2013.01); *F15B 2211/426* (2013.01); *F15B 2211/46* (2013.01); *F15B 2211/613* (2013.01); *F15B 2211/6309* (2013.01); *F15B 2211/6313* (2013.01); *F15B 2211/6333* (2013.01); *F15B 2211/6346* (2013.01); *F15B 2211/6652* (2013.01); *F15B 2211/7053* (2013.01); *F15B 2211/761* (2013.01); *F15B 2211/785* (2013.01)

(58) Field of Classification Search
USPC ..... 60/475, 476
See application file for complete search history.

(56) References Cited

U.S. PATENT DOCUMENTS

| | | | | |
|---|---|---|---|---|
| 10,400,802 | B2 * | 9/2019 | Sugano | F15B 1/024 |
| 2015/0013320 | A1 | 1/2015 | Akiyama et al. | |
| 2015/0292183 | A1 * | 10/2015 | Hiraku | F15B 11/17 60/423 |
| 2015/0292526 | A1 * | 10/2015 | Saitoh | E02F 9/2289 60/477 |

OTHER PUBLICATIONS

Japanese-language Written Opinion (PCT/ISA/237) issued in PCT Application No. PCT/JP2017/040101 dated Feb. 6, 2018 (two (2) pages).

International Preliminary Report on Patentability (PCT/IB/338 & PCT/IB/373) issued in PCT Application No. PCT/JP2017/040101 dated Oct. 10, 2019, including English translation of document C2 (Japanese-language Written Opinion (PCT/ISA/237) previously filed on Jun. 24, 2019) (six (6) pages).

* cited by examiner

CONSTRUCTION MACHINE

TECHNICAL FIELD

The present invention relates to a construction machine which includes a hydraulic drive system for driving a hydraulic actuator such as a hydraulic excavator.

BACKGROUND ART

In the field of construction machines such as hydraulic excavators and wheel loaders, development of a hydraulic closed circuit is in progress, as a circuit which connects a bidirectionally tiltable hydraulic pump and a hydraulic actuator in a closed circuit form, feeds to the hydraulic actuator hydraulic working oil delivered from the bidirectionally tiltable hydraulic pump, and returns oil having returned from the hydraulic actuator to the bidirectionally tiltable hydraulic pump. A system which includes the hydraulic closed circuit controls a delivery rate of the bidirectionally tiltable hydraulic pump to control a driving speed of the hydraulic actuator.

Examples of this type of system equipped with this type of hydraulic closed circuit include a hydraulic drive system provided to increase a lowering speed of a work implement without using a large-capacity hydraulic pump (see Patent Document 1). A hydraulic drive system described in Patent Document 1 includes a hydraulic closed circuit constituted by a bidirectionally tiltable hydraulic pump and a hydraulic cylinder connected with each other via a hydraulic working oil flow path, and discharges a part of hydraulic working oil discharged from the hydraulic cylinder into a bleed-off flow path branched from the hydraulic working oil flow path without returning the part of the hydraulic working oil to the hydraulic pump at the time of high-speed lowering of the work implement by a pulling action of the hydraulic cylinder.

PRIOR ART DOCUMENT

Patent Document

Patent Document 1: JP-2014-20431-A

SUMMARY OF THE INVENTION

Problem to be Solved by the Invention

The hydraulic drive system described in Patent Document 1 supplies to the hydraulic cylinder hydraulic working oil delivered from the hydraulic pump via a control valve or not via the control valve, and returns hydraulic working oil discharged from the hydraulic cylinder into the hydraulic pump without discharging the hydraulic working oil to the bleed-off flow path at the time of lowering of the work implement at an extremely low speed in a state that the dead weight of the work implement acts on the hydraulic cylinder. In this case, the action speed of the hydraulic cylinder is determined by the flow rate of the hydraulic working oil sucked by the hydraulic pump from the hydraulic cylinder. The flow rate of the hydraulic working oil supplied to the hydraulic cylinder is adjusted by dividing the hydraulic working oil delivered from the hydraulic pump into a flow toward the hydraulic cylinder and a flow toward the bleed-off flow path using the control valve, or by controlling the pump capacity.

Meanwhile, in the case of the bidirectionally tiltable hydraulic pump capable of delivering hydraulic working oil in both directions, a leak amount from the hydraulic pump increases at a small tilting angle, i.e., at small suction and delivery rates. In this case, control accuracy of the pump flow rate may decrease.

Accordingly, highly accurate control of the delivery rate is difficult to achieve by the hydraulic drive system described in Patent Document 1 at the time of fine control of the position of the work implement, such as fine control of a claw tip position of a bucket downward, i.e., fine control of the tilting angle of the hydraulic pump. In this case, highly accurate control of the flow rate of the hydraulic working oil supplied to the hydraulic cylinder is also difficult to achieve. As a result, the hydraulic cylinder is difficult to drive at a desired action speed, and preferable fine control of the claw tip position of the bucket is difficult to perform. In other words, there is still room for improvement of operability during fine operation of the pulling action of the hydraulic cylinder.

The present invention has been developed to solve the aforementioned problems. An object of the present invention is to provide a construction machine capable of improving operability during fine operation of a pulling action of a hydraulic cylinder in a state that an external load is applied in a contraction direction of the hydraulic cylinder.

Means for Solving the Problem

For example, configurations as claimed in the claims are adopted to solve the aforementioned problems.

The present application includes a plurality of means for solving the aforementioned problems. One of the means includes: a hydraulic pump that is of bidirectional delivery type and bidirectional variable displacement type, and has a first port and a second port; a hydraulic cylinder that has a first hydraulic working oil chamber and a second hydraulic working oil chamber, and performs a pulling action in a case of discharge of hydraulic working oil from the first hydraulic working oil chamber, and a pushing action in the case of discharge of hydraulic working oil from the second hydraulic working oil chamber; a first flow path that connects the first port of the hydraulic pump and the first hydraulic working oil chamber of the hydraulic cylinder; a second flow path that connects the second port of the hydraulic pump and the second hydraulic working oil chamber of the hydraulic cylinder; a discharge flow path branched from the first flow path; a discharge valve that is disposed in the discharge flow path, and controls a flow rate of hydraulic working oil discharged from the first hydraulic working oil chamber of the hydraulic cylinder to the discharge flow path; an operation device that issues an instruction for an action of the hydraulic cylinder; and a controller that controls the hydraulic pump and the discharge valve based on the instruction of the operation device. The means is characterized in that the controller controls the hydraulic pump and the discharge valve such that at least a part of hydraulic working oil discharged from the first hydraulic working oil chamber of the hydraulic cylinder is discharged to the discharge flow path in accordance with an operation amount of the operation device when the operation amount of the operation device lies within a fine operation region during the pulling action of the hydraulic cylinder in a state that an external load is applied in a contraction direction of the hydraulic cylinder.

Advantages of the Invention

According to the present invention, at least a part of hydraulic working oil discharged from the first hydraulic working oil chamber of the hydraulic cylinder is discharged to the discharge flow path branched from the hydraulic closed circuit by using the discharge valve at the time of fine operation of the pulling action of the hydraulic cylinder in the state that an external load is applied in the contraction direction of the hydraulic cylinder. In this case, the action speed of the hydraulic cylinder during fine operation is controllable by the discharge valve. Accordingly, operability improves during fine operation of the pulling action of the hydraulic cylinder in the state that the external load is applied in the contraction direction of the hydraulic cylinder.

Problems, configurations and effects other than those described above will be clarified from following description.

MODES FOR CARRYING OUT THE INVENTION

A construction machine in each of embodiments of the present invention is hereinafter described with reference to the drawings.

Embodiment 1

Figure 1:
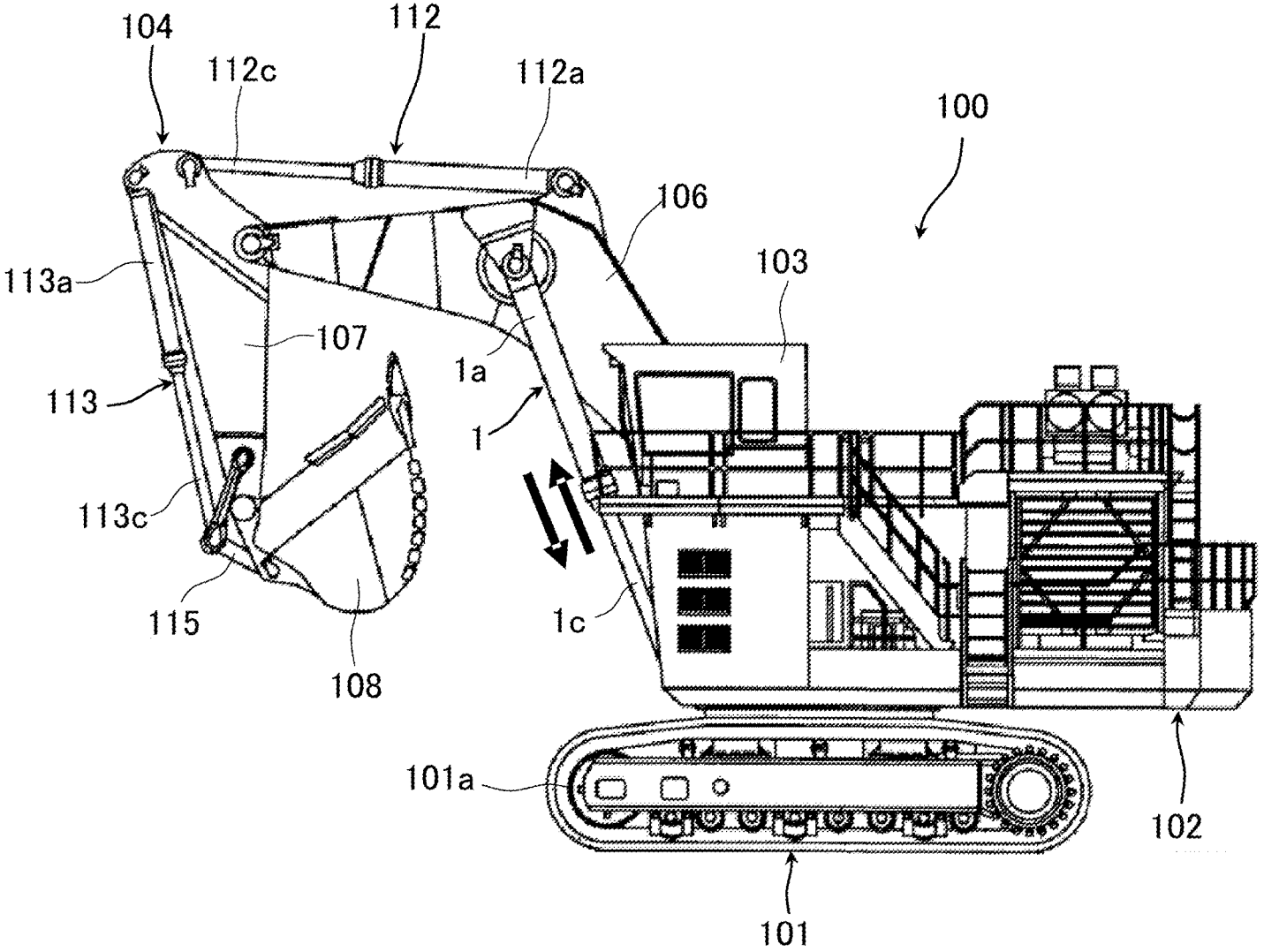
FIG. 1 is a side view illustrating a hydraulic excavator to which a construction machine of the present invention is applied.

Initially, a configuration of a hydraulic excavator is described with reference to FIG. 1 as an application example of the construction machine of the present invention. FIG. 1 is a side view illustrating a hydraulic excavator to which the construction machine of the present invention is applied. A "front" in the present description refers to a direction where an operator in a cab described below faces (left direction in FIG. 1).

In FIG. 1, a hydraulic excavator 100 includes a lower track structure 101 which has a crawler-type track device 101*a* on each of left and right sides (only one side is shown in FIG. 1), and an upper swing structure 102 attached as a main body onto the lower track structure 101 in such a manner as to swing thereon. The upper swing structure 102 houses various types of devices such as a prime mover (not shown), a hydraulic pump described below, and a plurality of valves. A cab 103 on which an operator boards is provided on the upper swing structure 102. The lower track structure 101 and the upper swing structure 102 are allowed to swing using a hydraulic motor (not shown).

A front work implement 104 is attached to the front of the upper swing structure 102. The front work implement 104 is a work device for performing excavating and the like, for example, and includes a boom 106, an arm 107, and a bucket 108. A proximal end of the boom 106 is joined to the front of the upper swing structure 102 in such a manner as to move upward and downward. A proximal end of the arm 107 is rotatably joined to a distal end of the boom 106. A proximal end of the bucket 108 is rotatably joined to a distal end of the arm 107.

The boom 106 is driven by a boom cylinder 1 functioning as a hydraulic actuator driven by supply of hydraulic working oil. The boom cylinder 1 is a single-rod type hydraulic cylinder which includes a cylinder tube 1*a*, a piston 1*b* (see FIG. 2) sliding within the cylinder tube 1*a*, and a rod 1*c* (see FIG. 2 as well) having a proximal end connected to the piston 1*b* and a distal end extending outside the cylinder tube 1*a*. The rod 1*c* projects in one direction. For example, the boom cylinder 1 is configured such that the distal end of the rod 1*c* is joined to the upper swing structure 102, and that a proximal end of the cylinder tube 1*a* is joined to the boom 106.

The arm 107 is driven by an arm cylinder 112 functioning as a hydraulic actuator. Similarly to the boom cylinder 1, the arm cylinder 112 is a single-rod type hydraulic cylinder which includes a cylinder tube 112*a*, a piston (not shown), and a rod 112*c* projecting in one direction. For example, the arm cylinder 112 is configured such that a proximal end of the cylinder tube 112*a* is joined to the boom 106, and that a distal end of the rod 112*c* is joined to the arm 107.

The bucket 108 is driven by a bucket cylinder 113 functioning as a hydraulic actuator. Similarly to the boom cylinder 1, the bucket cylinder 113 is a single-rod type hydraulic cylinder which includes a cylinder tube 113*a*, a piston (not shown), and a rod 113*c* projecting in one direction. For example, the bucket cylinder 113 is configured such that a proximal end of the cylinder tube 113*a* is joined to the arm 107, and that a distal end of the rod 113*c* is joined to the bucket 108 via a link 115.

Each of the boom 106, the arm 107, and the bucket 108 constituting the front work implement 104 is driven by a hydraulic drive system described below (see FIG. 2).

A configuration of the hydraulic drive system included in the construction machine according to Embodiment 1 of the present invention is now described with reference to FIG. 2. FIG. 2 is a hydraulic circuit diagram showing the configuration of the hydraulic drive system included in the construction machine according to Embodiment 1 of the present invention. While FIG. 2 shows only the hydraulic drive system for driving the boom, each of hydraulic drive systems for driving the arm and the bucket has a similar configuration. Accordingly, the same description of the configuration is not repeated herein. Parts in FIG. 2 identical to parts in FIG. 1 are given reference numbers identical to reference numbers of the corresponding parts in FIG. 1, and detailed description of the identical parts is not repeated herein.

Figure 2:
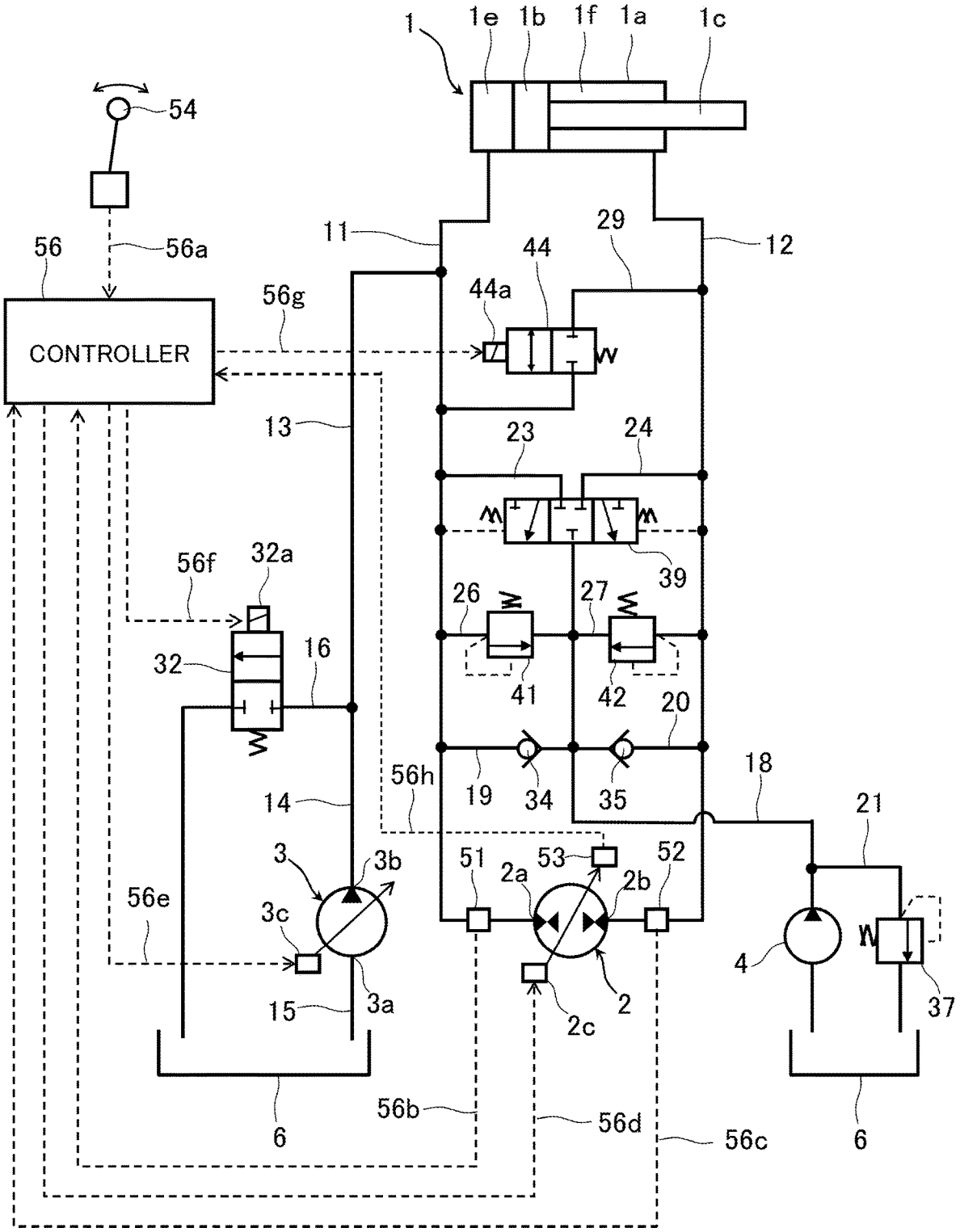
FIG. 2 is a hydraulic circuit diagram showing a configuration of a hydraulic drive system of a construction machine according to Embodiment 1 of the present invention.

In FIG. 2, the hydraulic drive system includes a boom cylinder 1, a first hydraulic pump 2 which is a bidirectional delivery type and a bidirectional variable displacement type, and connected to the boom cylinder 1 in a closed circuit form, a second hydraulic pump 3 which supplies hydraulic working oil to the boom cylinder 1, and a prime mover (not shown) for driving the first hydraulic pump 2 and the second hydraulic pump 3. For example, the prime mover is an engine or an electric motor capable of recovering power of the first hydraulic pump 2.

The boom cylinder 1 is configured such that the inside of the cylinder tube 1*a* is sectioned by the piston 1*b* into a first hydraulic working oil chamber 1*e* (hereinafter referred to as cap chamber) located on cap side and on the proximal end side of the cylinder tube 1*a*, and a second hydraulic working oil chamber 1*f* (hereinafter referred to as rod chamber) located on rod 1*c* side and the distal end side of the cylinder tube 1*a*. The boom cylinder 1 performs a pulling action (boom lowering) by a contracting shift of the rod 1*c* at the time of discharge of hydraulic working oil from the cap chamber 1*e* and supply of hydraulic working oil to the rod chamber 1*f*. The boom cylinder 1 also performs a pushing action (boom raising) by an extending shift of the rod 1*c* at the time of discharge of hydraulic working oil from the rod chamber 1*f* and supply of hydraulic working oil to the cap chamber 1*e*.

A pressure receiving area of the cap chamber 1*e* of the boom cylinder 1 is larger than a pressure receiving area of the rod chamber 1*f* by a cross-sectional area of the rod 1*c*. Accordingly, for expanding the boom cylinder 1, a larger amount of hydraulic working oil than an amount of hydraulic working oil discharged from the rod chamber 1*f* needs to be supplied to the cap chamber 1*e*. For contracting the boom cylinder 1, a larger amount of hydraulic working oil than an amount of hydraulic working oil supplied to the rod chamber 1*f* needs to be discharged from the cap chamber 1*e*.

The first hydraulic pump 2 is a bidirectionally tiltable hydraulic pump, for example, and includes a bidirectionally tiltable swash plate mechanism functioning as flow rate adjustment means and including a first port 2*a* and a second port 2*b* as a pair of input and output ports, and a regulator 2*c* which adjusts a tilting direction and an tilting angle of a swash plate. Switching between directions of delivery and suction, and adjustment of a displacement capacity (pump capacity) are achievable by changing the tilting direction and the tilting angle of the swash plate. The first hydraulic pump 2 functions as a hydraulic motor when hydraulic working oil having a pressure higher than that of hydraulic working oil on the delivery side is supplied to the suction side. The first hydraulic pump 2 is provide with a tilting angle sensor 53 for detecting a tilting angle of the swash plate of the first hydraulic pump 2.

The second hydraulic pump 3 is a variable displacement hydraulic pump performing unidirectional delivery, such as a single tilting pump. The second hydraulic pump 3 includes a single tilting swash plate mechanism functioning as flow rate adjustment means and having a suction port 3*a* and a delivery port 3*b*, and a regulator 3*c* which adjusts an tilting angle of a swash plate. A pump displacement volume is adjusted by adjusting the tilting angle of the swash plate.

The cap chamber 1*e* of the boom cylinder 1 and the first port 2*a* of the first hydraulic pump 2 are connected to each other via a first flow path 11. The rod chamber 1*f* of the boom cylinder 1 and the second port 2*b* of the first hydraulic pump are connected to each other via a second flow path 12. In this manner, the boom cylinder 1, the first hydraulic pump 2, the first flow path 11, and the second flow path 12 constitute a hydraulic closed circuit. A first pressure sensor 51 functioning as a pressure sensor for detecting a suction pressure or a delivery pressure of the first hydraulic pump 2 is provided on the first port 2*a* side of the first hydraulic pump 2 in the first flow path 11. A second pressure sensor 52 functioning as a pressure sensor for detecting a suction pressure or a delivery pressure of the first hydraulic pump is provided on the second port 2*b* side of the first hydraulic pump 2 in the second flow path 12.

A third flow path 13 is branched from the first flow path 11. One end of a supply flow path 14 is connected to the other end of the third flow path 13, while the other end of the supply flow path 14 is connected to the delivery port 3*b* of the second hydraulic pump 3. In this manner, the second hydraulic pump 3 is connected to the cap chamber 1*e* of the boom cylinder 1 via the supply flow path 14, the third flow path 13, and the first flow path 11. The suction port 3*a* of the second hydraulic pump 3 is connected to a hydraulic working oil tank 6 via a fourth flow path 15. Each of the supply flow path 14 and the third flow path 13 functions as a supply flow path which supplies, to the cap chamber 1*e* of the boom cylinder 1, hydraulic working oil delivered from the second hydraulic pump 3 during the pushing action of the boom cylinder 1. One end of a discharge flow path 16 is also connected to the other end of the third flow path 13, while the other end of the discharge flow path 16 is connected to the hydraulic working oil tank 6. Accordingly, the discharge flow path 16 is a flow path branched from the first flow path 11 of the hydraulic closed circuit via the third flow path 13. Each of the discharge flow path 16 and the third flow path 13 functions as a discharge flow path which discharges, from the hydraulic closed circuit, a part or all of hydraulic working oil discharged from the cap chamber 1*e* of the boom cylinder 1 during the pulling action of the boom cylinder 1. Accordingly, the third flow path 13 has both functions as the supply flow path during the pushing action of the boom cylinder 1, and as the discharge flow path during the pulling action of the boom cylinder 1.

A discharge valve 32 is provided in the discharge flow path 16. The discharge valve 32 controls a flow rate of hydraulic working oil discharged from the cap chamber 1*e* of the boom cylinder 1 to the discharge flow path 16. For example, the discharge valve 32 is an electromagnetic driving type proportional valve. The opening of the discharge valve 32 is adjusted in accordance with a command signal input to a solenoid 32*a*. When the discharge valve 32 is opened, the cap chamber 1*e* of the boom cylinder 1 and the hydraulic working oil tank 6 communicate with each other via the first flow path 11, the third flow path 13, and the discharge flow path 16.

The hydraulic drive system further includes a charge pump 4 which supplies hydraulic working oil to the hydraulic closed circuit. The charge pump 4 is a fixed displacement hydraulic pump which sucks hydraulic working oil from the hydraulic working oil tank 6. The delivery side of the charge pump 4 is connected to the first flow path 11 via a charge flow path 18 and a fifth flow path 19 branched from the charge flow path 18, and is connected to the second flow path 12 via a sixth flow path 20 branched from the charge flow path 18.

The fifth flow path 19 and the sixth flow path 20 are provided with a first check valve 34 and a second check valve 35, respectively. Each of the first check valve 34 and the second check valve 35 is set such that a flow direction of hydraulic working oil is limited to a direction from the charge flow path 18 toward the first flow path 11 and the second flow path 12 to prevent discharge of hydraulic working oil from the first flow path 11 and the second flow path 12 toward the charge flow path 18.

When the oil pressure in the first flow path 11 becomes lower than the oil pressure in the charge flow path 18, the first check valve 34 is opened to suck hydraulic working oil delivered from the charge pump 4 into the first flow path 11. When the oil pressure in the second flow path 12 becomes lower than the oil pressure in the charge flow path 18, the second check valve 35 is opened to suck hydraulic working oil from the charge pump 4 into the second flow path 12. In this manner, generation of cavitation within the hydraulic closed circuit is avoidable.

The delivery side of the charge pump 4 is further connected to the hydraulic working oil tank 6 via a first relief flow path 21 branched from the charge flow path 18. The first relief flow path 21 is provided with a first relief valve 37. The first relief valve 37 allows hydraulic working oil to flow from the charge flow path 18 to the hydraulic working oil tank 6 to protect the circuit when the pressure of the hydraulic working oil in the charge flow path 18 becomes a set pressure or higher.

The hydraulic drive system further includes a flushing valve 39 which connects the low pressure side of either the first flow path 11 or the second flow path 12 of the hydraulic closed circuit to the charge flow path 18. The flushing valve 39 is switchable between three positions, and configured to be driven by a pilot pressure introduced from the first flow path 11 and the second flow path 12, and maintain neutrality by springs. At a neutral position, connection between the hydraulic closed circuit and the charge flow path 18 is cut off. The flushing valve 39 connects the first flow path 11 or the second flow path 12 to the charge flow path 18 via a seventh flow path 23 or an eighth flow path 24 by switching of the position. When a surplus flow is produced within the hydraulic closed circuit by transient collapse of a flow ratio balance between the first hydraulic pump 2 and the second hydraulic pump 3, the flushing valve 39 is driven to discharge the surplus flow from the low pressure side of either the first flow path 11 or the second flow path 12 of the hydraulic closed circuit to the charge flow path 18. Accordingly, a pressure increase within the hydraulic closed circuit is avoidable. In this case, discharge of the surplus flow from the low pressure side decreases energy losses. Moreover, when flow shortage is produced within the hydraulic closed circuit, the flushing valve 39 is driven to supply hydraulic working oil from the charge flow path 18 to the low pressure side of either the first flow path 11 or the second flow path 12 of the hydraulic closed circuit. Accordingly, generation of a negative pressure within the hydraulic closed circuit is avoidable.

The hydraulic drive system includes a relief circuit for protecting the hydraulic closed circuit. The relief circuit includes a second relief flow path 26 which connects the first flow path 11 and the charge flow path 18, and a third relief flow path 27 which connects the second flow path 12 and the charge flow path 18. The second relief flow path 26 and the third relief flow path 27 include a second relief valve 41 and a third relief valve 42, respectively. The second relief valve 41 and the third relief valve 42 allow hydraulic working oil in the first flow path 11 and the second flow path 12 to flow out to the charge flow path 18 to protect the hydraulic closed circuit when each pressure in the first flow path 11 and the second flow path 12 becomes a set pressure or higher.

The hydraulic drive system further includes a recovery flow path 29 which connects the first flow path 11 and the second flow path 12, and a recovery valve 44 disposed in the recovery flow path 29. The recovery valve 44 conducts hydraulic working oil on high pressure side within the hydraulic closed circuit to the low pressure side, and controls the flow rate of the hydraulic working oil flowing in the recovery flow path 29. For example, the recovery valve 44 is an electromagnetic driving type proportional valve. The opening of the recovery valve 44 is adjusted in accordance with a command signal input to a solenoid 44*a*. When the recovery valve 44 is opened, the cap chamber 1*e* and the rod chamber 1*f* of the boom cylinder 1 communicate with each other via the first flow path 11, the recovery flow path 29, and the second flow path 12.

The hydraulic drive system further includes an operation lever device 54 functioning as an operation device that issues an instruction for an action of the boom cylinder 1. An action direction and an action speed of the boom cylinder 1 are instructed by an operation direction and an operation angle (operation amount) of the lever of the operation lever device 54.

The hydraulic drive system further includes a controller 56 for controlling the first hydraulic pump 2, the second hydraulic pump 3, the discharge valve 32, and the recovery valve 44 on the basis of instructions from the operation lever device 54 and information from various types of sensors. The controller 56 is connected to the operation lever device 54 via an operation signal line 56*a*. The controller 56 is further connected to the first pressure sensor 51 and the second pressure sensor 52 via pressure signal lines 56*c* and 56*c*. The controller 56 is further connected to the regulator 2*c* of the first hydraulic pump 2 via a first regulator signal line 56*d*, and connected to the regulator 3*c* of the second hydraulic pump 3 via a second regulator signal line 56*e*. The controller 56 is further connected to the solenoid 32*a* of the discharge valve 32 via a first flow rate signal line 56*f*, and connected to the solenoid 44*a* of the recovery valve 44 via a second flow rate signal line 56*g*. The controller 56 is further connected to the tilting angle sensor 53 via a tilting angle signal line 56*h*.

Figure 3:
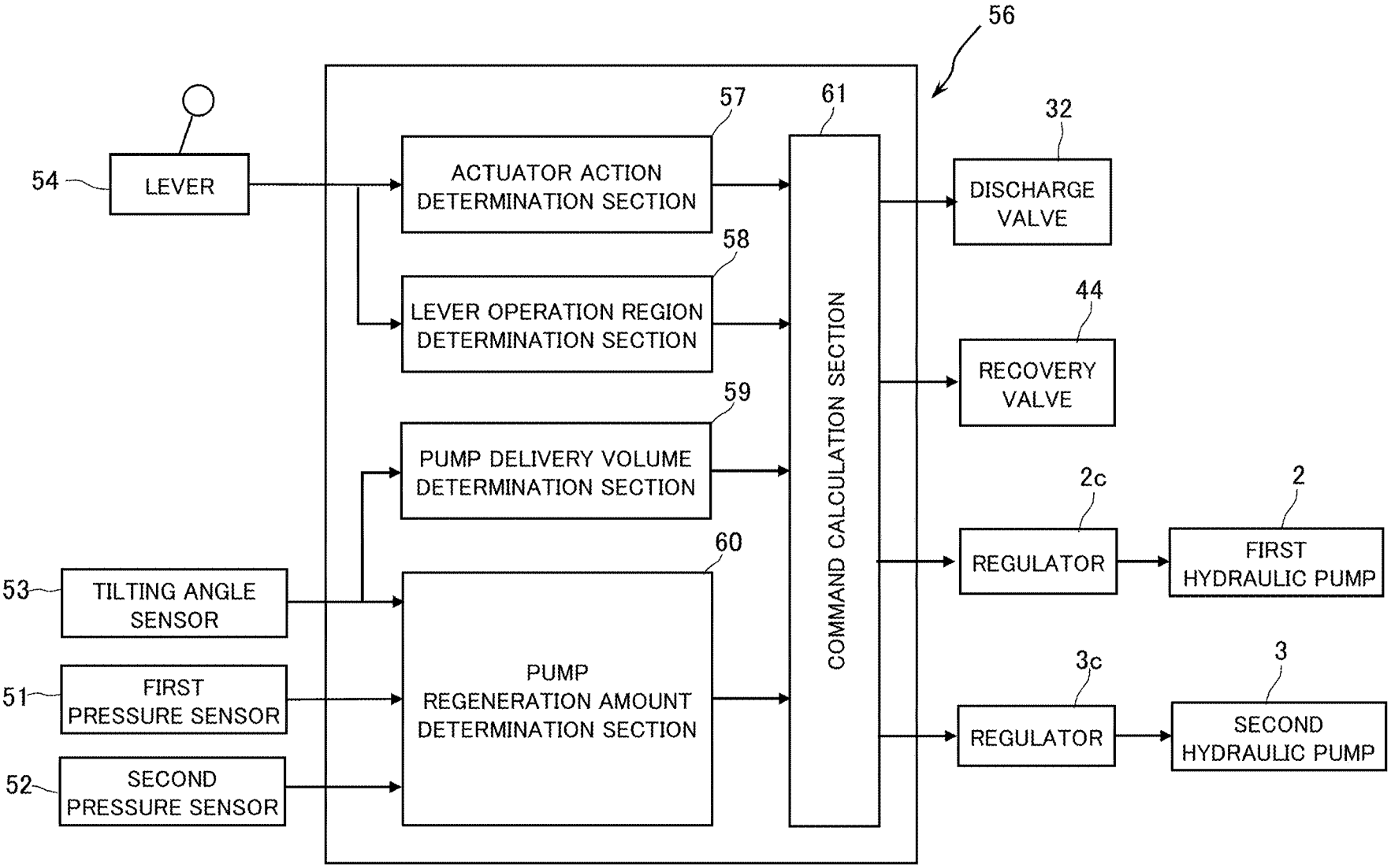
FIG. 3 is a block diagram showing functions of a controller in FIG. 2.

Functions of the controller constituting a part of the construction machine according to Embodiment 1 of the present invention are now described with reference to FIG. 3. FIG. 3 is a block diagram showing the functions of the controller shown in FIG. 2. Parts in FIG. 3 identical to parts in FIGS. 1 and 2 are given reference numbers identical to reference numbers of the corresponding parts in FIGS. 1 and 2, and detailed description of the identical parts is not repeated herein.

The controller 56 inputs an operation signal corresponding to an operation direction and an operation amount of the lever of the operation lever device 54. The controller 56 further inputs pressure detection signals of the first pressure sensor 51 and the second pressure sensor 52. The controller 56 further inputs a tilting angle detection signal of the tilting angle sensor 53. The controller 56 is constituted by an actuator action determination section 57, a lever operation region determination section 58, a pump delivery volume determination section 59, a pump regeneration amount determination section 60, and a command calculation section 61.

The actuator action determination section 57 determines which of the pulling action (boom lowering) and the pushing action (boom raising) of the boom cylinder 1 is to be performed based on the operation signal of the lever of the operation lever device 54, and outputs a result of this determination to the command calculation section 61.

The lever operation region determination section 58 determines whether or not an operation amount of the lever lies within a "fine operation region" based on the operation signal of the lever of the operation lever device 54, and outputs a result of this determination to the command calculation section 61. The fine operation region refers to an operation range of the lever for extremely low speed control of the boom cylinder 1. For example, the fine operation region is established as an operation range where highly accurate flow rate control is difficult due to an extremely low suction and delivery rates of the first hydraulic pump 2. More specifically, the fine operation region is a range where an operation amount (operation angle) of the lever ranges from an amount larger than 0% (0°) in neutral to approximately 25% of the whole operation region, for example (see FIGS. 5 and 6 referred to below).

The pump delivery volume determination section 59 calculates a pump delivery volume of the first hydraulic pump 2 on the basis of a tilting angle detection signal of the tilting angle sensor 53. The pump delivery volume determination section 59 further determines whether or not a result of this calculation is the maximum delivery volume, and outputs a result of this determination to the command calculation section 61.

The pump regeneration amount determination section 60 calculates a pump delivery volume of the first hydraulic pump 2 based on the tilting angle detection signal of the tilting angle sensor 53, and calculates a regeneration amount of the first hydraulic pump 2 on the basis of a result of this calculation and pressure detection signals of the first pressure sensor 51 and the second pressure sensor 52. The pump regeneration amount determination section 60 further determines whether or not the calculation result of the regeneration amount of the first hydraulic pump 2 is the maximum regeneration amount of the first hydraulic pump 2, and outputs a result of this determination to the command calculation section 61.

The command calculation section 61 generates a command signal for designating suction and delivery directions and suction and delivery rates of the first hydraulic pump 2 on the basis of determination results of the actuator action determination section 57, the lever operation region determination section 58, the pump delivery volume determination section 59, and the pump regeneration amount determination section 60, and outputs the generated command signal to the regulator 2*c* of the first hydraulic pump 2. The command calculation section 61 further generates a command signal for designating a delivery rate of the second hydraulic pump 3 on the basis of determination results of the actuator action determination section 57, the lever operation region determination section 58, the pump delivery volume determination section 59, and the pump regeneration amount determination section 60, and outputs the generated command signal to the regulator 3*c* of the second hydraulic pump 3.

The command calculation section 61 generates a command signal for designating an opening of the discharge valve 32 on the basis of determination results of the actuator action determination section 57, the lever operation region determination section 58, the pump delivery volume determination section 59, and the pump regeneration amount determination section 60, and outputs the generated command signal to the solenoid 32*a* of the discharge valve 32. In this manner, the flow rate of hydraulic working oil discharged from the cap chamber 1*e* of the boom cylinder 1 to the hydraulic working oil tank 6 via the discharge flow path 16 is controlled. The command calculation section 61 further generates a command signal for designating an opening of the recovery valve 44 on the basis of determination results of the actuator action determination section 57, the lever operation region determination section 58, the pump delivery volume determination section 59, and the pump regeneration amount determination section 60, and outputs the generated command signal to the solenoid 44*a* of the recovery valve 44. In this manner, the flow rate of hydraulic working oil discharged from the cap chamber 1*e* of the boom cylinder 1 to the rod chamber if of the boom cylinder 1 via the recovery flow path 29 is controlled.

Figure 4:
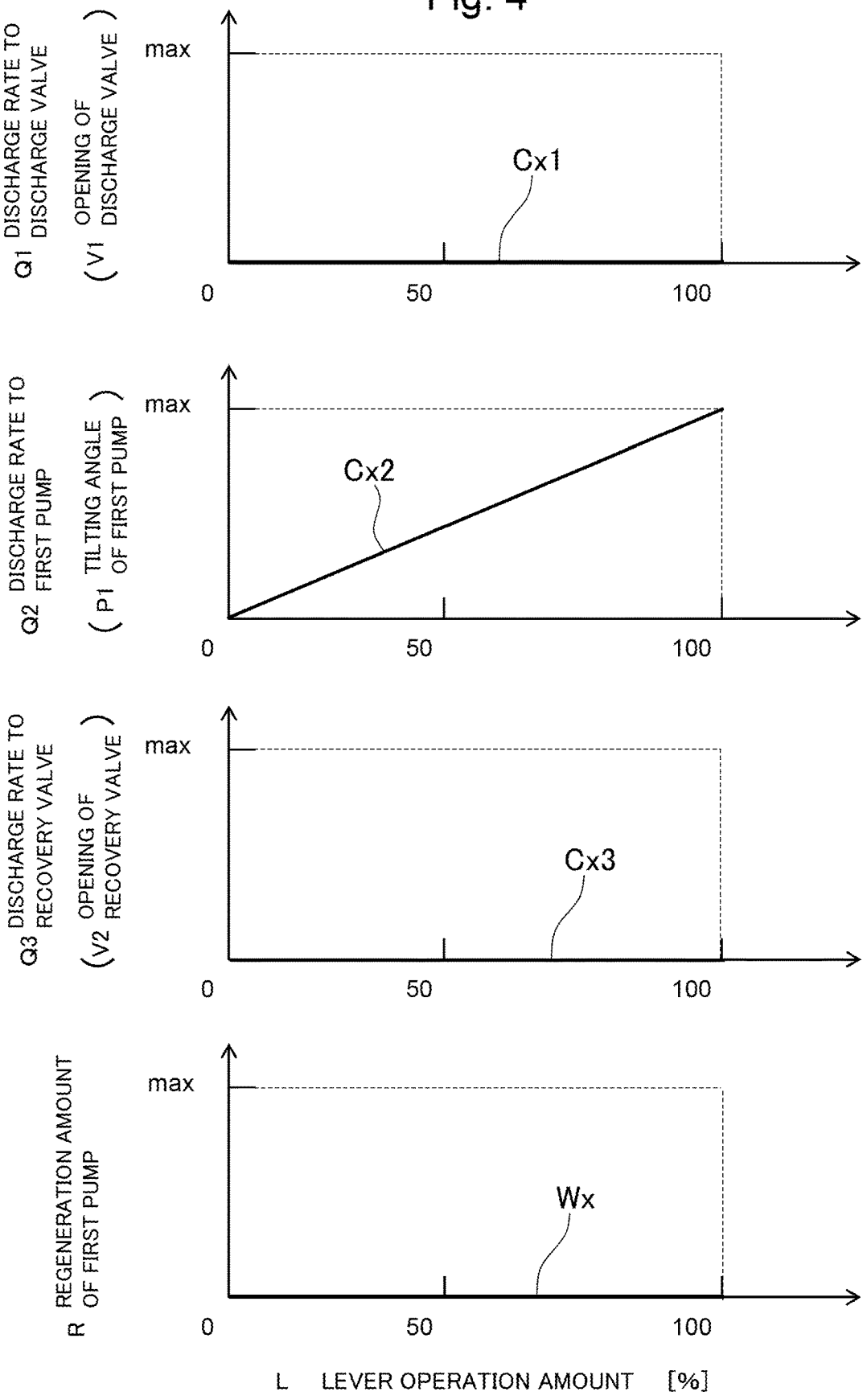
FIG. 4 is a characteristic diagram showing an example of a control method performed by the controller shown in FIG. 3 for a discharge valve, a first hydraulic pump, and a recovery valve at the time of a pushing action of a boom cylinder (boom raising).
Figure 5:
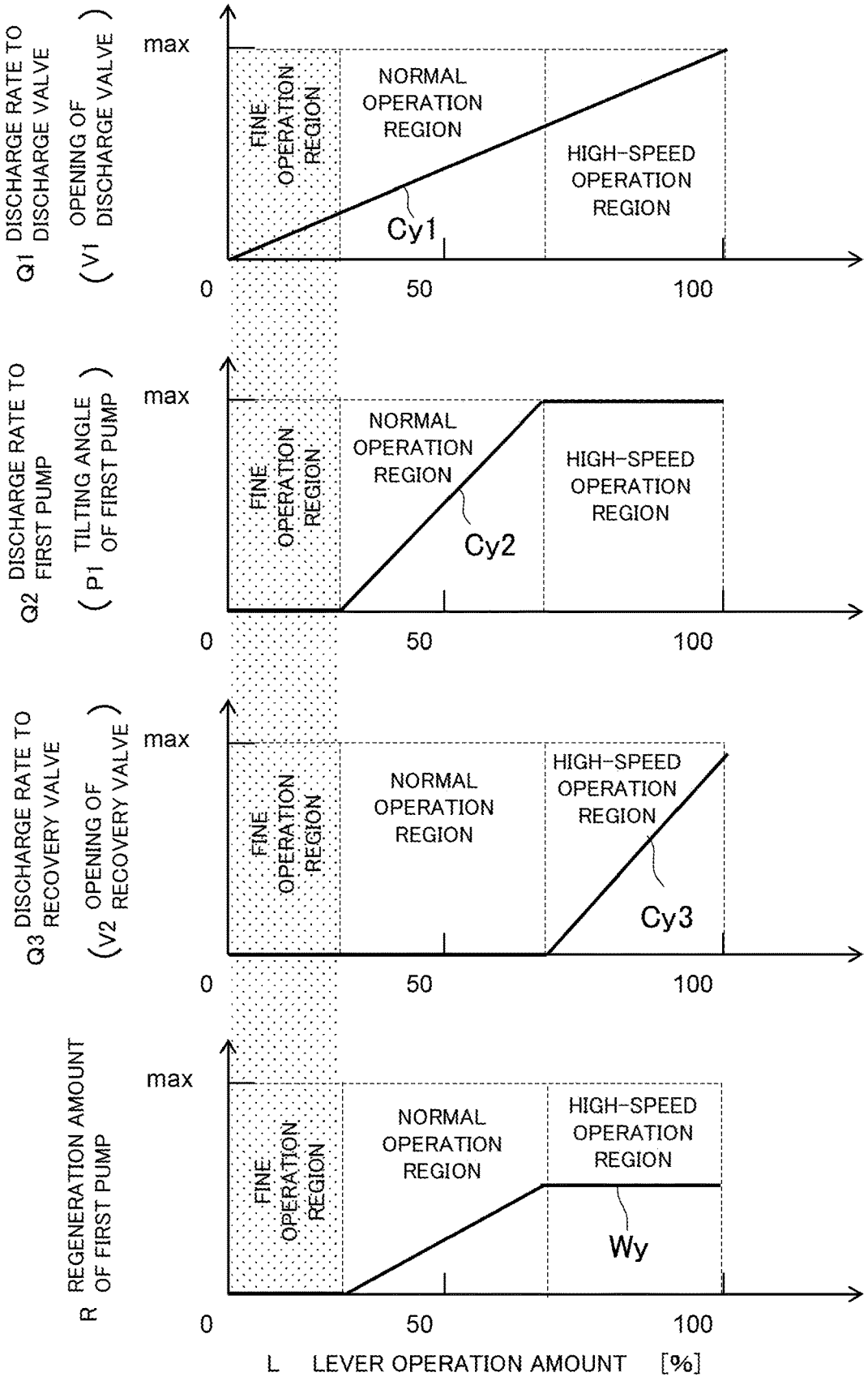
FIG. 5 is a characteristic diagram showing an example of a control method performed by the controller shown in FIG. 3 for the discharge valve, the first hydraulic pump, and the recovery valve at the time of a pulling action of the boom cylinder (boom lowering), and is a diagram in a case where a pump delivery volume of the first hydraulic pump reaches the maximum before an operation amount becomes the maximum.
Figure 6:
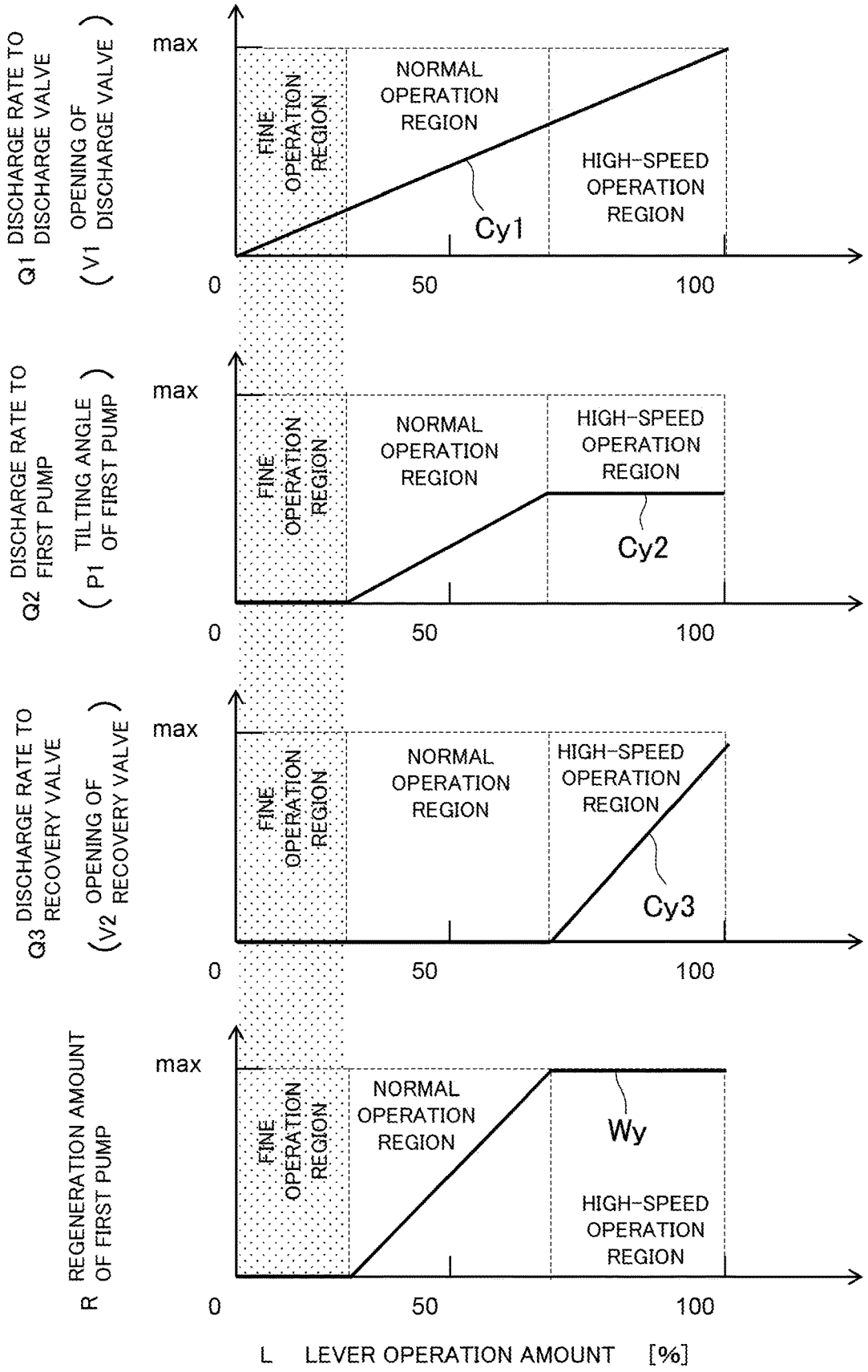
FIG. 6 is a characteristic diagram showing an example of a control method performed by the controller shown in FIG. 3 for the discharge valve, the first hydraulic pump, and the recovery valve at the time of a pulling action of the boom cylinder (boom lowering), and is a diagram in a case where a regeneration amount of the first hydraulic pump reaches the maximum before the operation amount becomes the maximum.

Described next with reference to FIGS. 2 to 6 are details of control performed by the controller constituting the construction machine according to Embodiment 1 of the present invention for the discharge valve, the first hydraulic pump, and the recovery valve. FIG. 4 is a characteristic diagram showing an example of a control method performed by the controller shown in FIG. 3 for the discharge valve, the first hydraulic pump, and the recovery valve at the time of pushing action (boom raising) of the boom cylinder. FIG. 5 is a characteristic diagram showing an example of a control method performed by the controller shown in FIG. 3 for the discharge valve, the first hydraulic pump, and the recovery valve at the time of pulling action (boom lowering) of the boom cylinder when the pump delivery volume of the first hydraulic pump reaches the maximum before the operation amount becomes the maximum. FIG. 6 is a characteristic diagram showing an example of a control method performed by the controller shown in FIG. 3 for the discharge valve, the first hydraulic pump, and the recovery valve at the time of pulling action (boom lowering) of the boom cylinder when the regeneration amount of the first hydraulic pump reaches the maximum before the operation amount becomes the maximum.

A horizontal axis L in each of FIGS. 4 to 6 indicates a lever operation amount of the operation lever device 54. A vertical axis Q1 (V1) indicates a discharge rate to the hydraulic working oil tank 6 via the discharge valve 32 (opening of discharge valve). A vertical axis Q2 (P1) indicates a discharge rate from the cap chamber 1*e* to the first hydraulic pump 2 (tilting angle of first hydraulic pump). A vertical axis Q3 (V2) indicates a discharge rate from the cap chamber 1*e* to the recovery flow path 29 via the recovery valve 44 (opening of recovery valve). A vertical axis R indicates a regeneration amount of the first hydraulic pump 2. Parts in FIGS. 4 to 6 identical to parts in FIGS. 1 to 3 are given identical reference numbers, and the detailed description of the identical parts is not repeated herein.

Initially described is a control in a case where an instruction of the pushing action (boom raising) of the boom cylinder 1 is issued from the operation lever device 54. The command calculation section 61 of the controller 56 controls the flow rate of the hydraulic working oil supplied to the cap chamber 1*e* of the boom cylinder 1 and the flow rate of the hydraulic working oil discharged from the rod chamber 1*f*, such that an action speed of the boom cylinder 1 becomes a speed corresponding to the operation amount of the operation lever device 54. More specifically, the discharge valve 32, the first hydraulic pump 2, and the recovery valve 44 are controlled in the following manner.

The controller 56 normally closes the discharge valve 32 as indicated by a solid line Cx1 in FIG. 4. Accordingly, connection between the hydraulic working oil tank 6 and the first flow path 11 shown in FIG. 2 is normally cut off. In other words, the controller 56 performs control such that the flow rate of the hydraulic working oil discharged to the hydraulic working oil tank 6 via the discharge valve 32 becomes 0 regardless of the lever operation amount.

The controller 56 further performs control such that the tilting angle of the swash plate of the first hydraulic pump 2 increases in accordance with an increase in the lever operation amount as indicated by a solid line Cx2 in FIG. 4. That is, the controller 56 performs control such that the supply rate from the first hydraulic pump 2 to the cap chamber 1*e* and the discharge rate from the rod chamber 1*f* to the first hydraulic pump 2 (suction and delivery rates of first hydraulic pump 2) shown in FIG. 2 increase in accordance with an increase in the lever operation amount. In this case, shortage of hydraulic working oil supply to the cap chamber 1*e* produced by the difference in the pressure receiving area between the cap chamber 1*e* and the rod chamber 1*f* needs to be cancelled by supplying hydraulic working oil from the second hydraulic pump 3. Accordingly, the controller 56 performs such control that the pump capacities of the first hydraulic pump 2 and the second hydraulic pump 3 obtain a predetermined relationship corresponding to the difference in the pressure receiving area between the cap chamber 1*e* and the rod chamber 1*f*.

In addition, the controller 56 normally closes the recovery valve 44 as indicated by a solid line Cx3 in FIG. 4. Accordingly, connection between the first flow path 11 and the second flow path 12 via the recovery flow path 29 shown in FIG. 2 is normally cut off. In other words, the controller 56 performs control such that the flow rate of the hydraulic working oil flowing from the first flow path 11 on the high pressure side to the second flow path 12 on the low pressure side via the recovery valve 44 becomes 0 regardless of the lever operation amount.

Next described is a control in a case where an instruction of the pulling action of the boom cylinder 1 is issued from the operation lever device 54 in a state that an external load is applied in the contraction direction of the boom cylinder (e.g., boom lowering under the condition that the dead weight of the front work implement 104 acts). The command calculation section 61 of the controller 56 controls the flow rate of the hydraulic working oil discharged from the cap chamber 1*e* of the boom cylinder 1, such that the action speed of the boom cylinder 1 becomes a speed corresponding to the lever operation amount. More specifically, the discharge valve 32, the first hydraulic pump 2, and the recovery valve 44 are controlled in the following manner.

The controller 56 performs control such that the opening of the discharge valve 32 increases in accordance with an increase in the lever operation amount as indicated by a solid line Cy1 in FIGS. 5 and 6. As a result, the cap chamber 1*e* and the hydraulic working oil tank 6 shown in FIG. 2 communicate with each other via the third flow path 13 and the discharge flow path 16. That is, the controller 56 controls the discharge valve 32 such that the discharge rate from the cap chamber 1*e* to the hydraulic working oil tank 6 via the discharge valve 32 increases in accordance with an increase in the lever operation amount.

The controller 56 further performs control such that the tilting angle of the swash plate of the first hydraulic pump 2 becomes 0 regardless of the lever operation amount as indicated by a solid line Cy2 in FIGS. 5 and 6 when the lever operation amount lies within the fine operation region. In other words, the controller 56 controls the pump delivery volume of the first hydraulic pump 2 such that the discharge rate from the cap chamber 1*e* to the first hydraulic pump 2 and the supply rate from the first hydraulic pump 2 to the rod chamber 1*f* (suction and delivery rates of first hydraulic pump 2) become 0 regardless of the lever operation amount.

On the other hand, when the lever operation amount exceeds the fine operation region, the controller 56 performs control such that the tilting angle of the swash plate of the first hydraulic pump 2 increases in accordance with an increase in the lever operation amount. That is to say, the controller 56 controls the pump delivery volume of the first hydraulic pump 2 such that the discharge rate from the cap chamber 1*e* to the first hydraulic pump 2 and the supply rate from the first hydraulic pump 2 to the rod chamber 1*f* (suction and delivery rates of first hydraulic pump 2) increase in accordance with an increase in the lever operation amount.

However, when the pump delivery volume of the first hydraulic pump 2 reaches the maximum before the time when the lever operation amount becomes the maximum (100%), the controller 56 performs control to maintain the tilting angle of the swash plate of the first hydraulic pump at a fixed angle (maximum) with respect to an increase in the lever operation amount produced after the time of the maximum pump delivery volume as indicated by the solid line Cy2 in FIG. 5. In other words, the controller 56 controls the pump delivery volume of the first hydraulic pump 2 such that the discharge rate from the cap chamber 1*e* to the first hydraulic pump 2 and the supply rate from the first hydraulic pump 2 to the rod chamber 1*f* (suction and delivery rates of first hydraulic pump 2) are maintained at fixed rates (maximums) regardless of an increase in the lever operation amount.

When the regeneration amount of the first hydraulic pump 2 reaches the maximum before the time when the lever operation amount becomes the maximum (100%), the controller 56 performs control to maintain the tilting angle of the swash plate of the first hydraulic pump 2 at a fixed angle with respect to an increase in the lever operation amount produced after the time of the maximum regeneration amount as indicated by the solid line Cy2 in FIG. 6. In other words, the controller 56 controls the pump delivery volume of the first hydraulic pump 2 such that the discharge rate from the cap chamber 1*e* to the first hydraulic pump 2 and the supply rate from the first hydraulic pump 2 to the rod chamber 1*f* (suction and delivery rates of first hydraulic pump 2) are maintained at fixed rates regardless of an increase in the lever operation amount.

The controller 56 closes the recovery valve 44 until the pump delivery volume or the regeneration amount of the first hydraulic pump 2 reaches the maximum as indicated by a solid line Cy3 in FIGS. 5 and 6. Accordingly, connection between the first flow path 11 and the second flow path 12 via the recovery flow path 29 shown in FIG. 2 is cut off. That is, the controller 56 controls the recovery valve 44 such that the discharge rate from the first flow path 11 on the high pressure side to the second flow path 12 on the low pressure side via the recovery valve 44 becomes 0 regardless of the lever operation amount.

When the pump delivery volume or the regeneration amount of the first hydraulic pump 2 reaches the maximum, the recovery valve 44 is opened to increase the opening of the recovery valve 44 in accordance with an increase in the lever operation amount produced after the time of the maximum pump delivery volume or regeneration amount. As a result, the cap chamber 1*e* and the rod chamber 1*f* shown in FIG. 2 are connected to each other via the recovery flow path 29. In other words, the controller 56 controls the recovery valve 44 such that the supply rate from the cap chamber 1*e* on the high pressure side to the rod chamber 1*f* on the low pressure side via the recovery valve 44 increases in accordance with an increase in the lever operation amount.

According to the present embodiment, therefore, the controller 56 controls the discharge valve 32, the first hydraulic pump 2, and the recovery valve 44 such that the entire amount of hydraulic working oil discharged from the cap chamber 1*e* can be discharged to the discharge flow path 16 when the lever operation amount lies in any range of the fine operation region. Accordingly, the action speed of the boom cylinder 1 becomes a speed corresponding to the discharge rate to the discharge flow path 16.

In a case where the lever operation amount exceeds the fine operation region, and where the pump delivery volume and the regeneration amount of the first hydraulic pump are smaller than the respective maximums (hereinafter also referred to as normal operation region), the discharge valve 32, the first hydraulic pump 2, and the recovery valve 44 are controlled such that a part of hydraulic working oil discharged from the cap chamber 1*e* is discharged to the hydraulic working oil tank 6 via the discharge flow path 16, and that the remained hydraulic working oil is discharged toward the first port 2*a* side of the first hydraulic pump 2. Accordingly, the action speed of the boom cylinder 1 becomes a speed corresponding to the total flow rate of the discharge rate to the discharge flow path 16 and the suction rate of the first hydraulic pump 2.

When the pump delivery volume or the regeneration amount of the first hydraulic pump 2 reaches the maximum (hereinafter also referred to as high-speed operation region), the controller 56 controls the discharge valve 32 and the first hydraulic pump 2 such that a part of hydraulic working oil discharged from the cap chamber 1*e* is discharged to the discharge flow path 16 and the first port 2*a* side of the first hydraulic pump 2, and controls the recovery valve 44 such that the remained hydraulic working oil is supplied to the rod chamber 1*f* via the recovery flow path 29. Accordingly, the action speed of the boom cylinder 1 becomes a speed corresponding to the total flow rate of the discharge rate to the discharge flow path 16, the suction rate of the first hydraulic pump 2, and the discharge rate to the recovery flow path 29.

Description of details of control performed at the time of the pulling action (boom lowering) of the boom cylinder 1 in a state that an external load is not applied in the contraction direction of the boom cylinder 1 is omitted. Basically, the controller 56 controls the action speed of the boom cylinder 1 by controlling the supply rate from the first hydraulic pump 2 to the rod chamber 1*f* in all regions of the lever operation. In other words, the controller 56 increases or decreases the delivery rate of the first hydraulic pump 2 in accordance with the lever operation amount even when the lever operation amount lies within the fine operation region.

Figure 7:
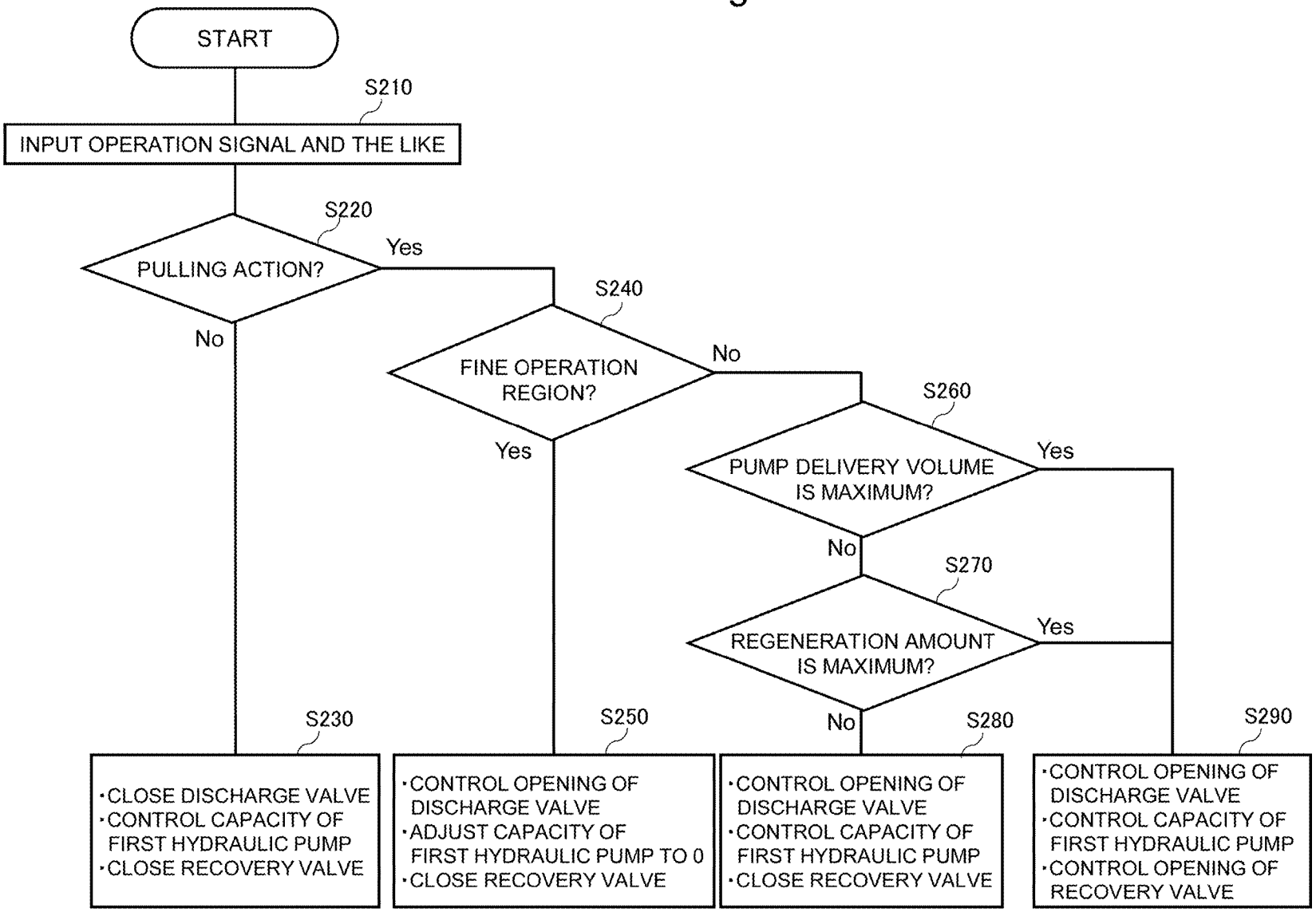
FIG. 7 is a flowchart showing an example of control procedures performed by the controller shown in FIG. 3.

Next described with reference to FIG. 7 is a control flow of the controller constituting the construction machine according to Embodiment 1 of the present invention. FIG. 7 is a flowchart showing an example of control procedures performed by the controller shown in FIG. 3. A control flow at the time of the pulling action of the boom cylinder 1 in a state that an external load is not applied in the contraction direction of the boom cylinder 1 is omitted in the present description.

The controller 56 is activated by an engine start up and initiates the control flow (start). The controller 56 initially inputs an operation signal of the operation lever device 54, pressure detection signals of the first pressure sensor 51 and the second pressure sensor 52, and a tilting angle detection signal of the tilting angle sensor 53 (step S210). Subsequently, the actuator action determination section 57 of the controller 56 determines whether or not an instruction of the operation lever device 54 indicates the pulling action of the boom cylinder 1 (boom lowering) on the basis of the input signals (step S220).

When it is determined in step S220 that the instruction is not the instruction of the pulling action of the boom cylinder 1 (in the case of NO), i.e., the instruction of the pushing action of the boom cylinder 1 (boom raising), the process proceeds to step S230. The command calculation section 61 of the controller 56 controls the discharge valve 32, the first hydraulic pump 2, and the recovery valve 44 in the following manner. The controller 56 normally closes the discharge valve 32 as indicated by the solid line Cx1 shown in FIG. 4. The controller 56 further controls the pump delivery volume of the first hydraulic pump 2 in accordance with the lever operation amount as indicated by the solid line Cx2 shown in FIG. 4. Moreover, the controller 56 normally closes the recovery valve 44 as indicated by the solid line Cx3 shown in FIG. 4.

During continuation of the operation of boom raising, the controller 56 repeats processing in steps S210 to S230 described above.

On the other hand, in the case of the instruction of the pulling action of the boom cylinder 1 in step S220 (in the case of YES), the process proceeds to step S240. The lever operation region determination section 58 of the controller 56 determines whether or not the lever operation amount lies within the fine operation region on the basis of the input operation signal. When the lever operation amount lies within the fine operation region (in the case of YES), the process proceeds to step S250. The command calculation section 61 of the controller 56 controls the discharge valve 32, the first hydraulic pump 2, and the recovery valve 44 in the following manner. The controller 56 controls the opening of the discharge valve 32 in accordance with the lever operation amount as indicated by the solid line Cy1 in the fine operation region shown in FIGS. 5 and 6. The controller 56 further adjusts the delivery volume of the first hydraulic pump 2 to 0 as indicated by the solid line Cy2 in the fine operation region shown in FIGS. 5 and 6. The controller 56 further closes the recovery valve 44 as indicated by the solid line Cy3 in the fine operation region shown in FIGS. 5 and 6.

During continuation of the operation of boom lowering in the fine operation region, the controller 56 repeats processing in steps S210, S220, S240, and S250 described above.

On the other hand, when the operation amount exceeds the fine operation region in step S240 (in the case of NO), the process proceeds to step S260. The pump delivery volume determination section 59 of the controller 56 determines whether or not the pump delivery volume of the first hydraulic pump 2 is the maximum on the basis of the input tilting angle detection signal. When the pump delivery volume of the first hydraulic pump 2 is not the maximum (in the case of NO), the process proceeds to step S270. The pump regeneration amount determination section 60 of the controller 56 determines whether or not the regeneration amount of the first hydraulic pump 2 is the maximum on the basis of the input tilting angle determination signal and pressure detection signals.

When the regeneration amount of the first hydraulic pump 2 is not the maximum in step S270 (in the case of NO), the process proceeds to step S280. The command calculation section 61 of the controller 56 controls the discharge valve 32, the first hydraulic pump 2, and the recovery valve 44 in the following manner. The controller 56 controls the opening of the discharge valve 32 in accordance with the lever operation amount as indicated by the solid line Cy1 in the normal operation region shown in FIGS. 5 and 6. The controller 56 further controls the delivery volume of the first hydraulic pump 2 in accordance with the lever operation amount as indicated by the solid line Cy2 in the normal operation region shown in FIGS. 5 and 6. The controller 56 further closes the recovery valve 44 as indicated by the solid line Cy3 in the normal operation region operation region shown in FIGS. 5 and 6.

During continuation of the operation of boom lowering in the normal operation region, the controller 56 repeats processing in steps S210, S220, S240, and S260 to S280 described above.

When the pump delivery volume or the regeneration amount of the first hydraulic pump 2 is the maximum in step S260 or S270 (in the case of YES), the process proceeds to step S290. The command calculation section 61 of the controller 56 controls the discharge valve 32, the first hydraulic pump 2, and the recovery valve 44 in the following manner. The controller 56 controls the opening of the discharge valve 32 in accordance with the lever operation amount as indicated by the solid line Cy1 in the high-speed operation region shown in FIGS. 5 and 6. The controller 56 further maintains the delivery volume of the first hydraulic pump 2 constant regardless of the lever operation amount as indicated by the solid line Cy2 in the high-speed operation region shown in FIGS. 5 and 6. The controller 56 further controls the opening of the recovery valve 44 in accordance with the lever operation amount as indicated by the solid line Cy3 in the high-speed operation region shown in FIGS. 5 and 6.

During continuation of the operation of the boom lowering under the situation where the pump delivery volume or regeneration amount of the first hydraulic pump 2 is maximum, the controller 56 repeats the processing described above.

An action of the construction machine according to Embodiment 1 of the present invention is next described with reference to FIGS. 2 to 7. Described herein are two types of actions, i.e., an initial action of boom raising, and a subsequent action of boom lowering in a state that the dead weight of the front work implement 104 acts in the contraction direction of the boom cylinder 1. The boom lowering in the following description is further divided into four scenes: a case where the lever operation amount lies within the fine operation region; a case where the lever operation amount lies within the normal operation region; a case where the pump delivery volume of the first hydraulic pump 2 lies within the maximum region (high-speed operation region); and a case where the regeneration amount of the first hydraulic pump 2 lies within the maximum region (high-speed operation region). The action at the time of boom lowering in a state that a load is not applied in the contraction direction of the boom cylinder 1 is omitted in the following description.

When an operator operates the lever of the operation lever device 54 shown in FIG. 2 from a neutral position to boom raising (pushing action of the boom cylinder 1), an operation signal corresponding to the operation direction and operation amount of the lever, pressure detection signals of the first and second pressure sensors 51 and 52, and a tilting angle detection signal of the tilting angle sensor 53 are input to the controller 56 (step S210 shown in FIG. 7). The controller 56 determines that the instruction of the operation lever device 54 is not the pulling action of the boom cylinder (determination of NO in step S220), and outputs a command signal corresponding to the pushing action of the boom cylinder 1 to each of the discharge valve 32, the first hydraulic pump 2, and the recovery valve 44 (step S230).

As a result, the discharge valve 32 comes into a closed state, and communication between the hydraulic working oil tank 6 and the first flow path 11 is cut off. The recovery valve 44 is in the closed state, and connection between the first flow path 11 and the second flow path 12 via the recovery flow path 29 is cut off. The pump delivery volume of the first hydraulic pump 2 becomes a volume corresponding to the lever operation amount, and hydraulic working oil at a flow rate corresponding to the operation amount is delivered from the first hydraulic pump 2. In this case, hydraulic working oil at a flow rate corresponding to shortage of supply to the cap chamber 1*e* of the first hydraulic pump 2 (shortage due to pressure receiving surface difference between cap chamber 1*e* and rod chamber 1*f*) is delivered from the second hydraulic pump 3 by the command signal from the controller 56.

Accordingly, the discharge rate to the hydraulic working oil tank 6 via the discharge valve 32 becomes 0 as indicated by the solid line Cx1 in FIG. 4, and the flow rate in the recovery flow path 29 produced by the recovery valve 44 becomes 0 as indicated by the solid line Cx3 in FIG. 4. In addition, a flow rate corresponding to the lever operation amount is discharged from the rod chamber 1*f* toward the second port 2*b* side of the first hydraulic pump 2 as indicated by the solid line Cx2 in FIG. 4, while a flow rate corresponding to the lever operation amount is supplied from the first hydraulic pump 2 and the second hydraulic pump 3 to the cap chamber 1*e*. As a result, the boom cylinder 1 extends at a speed corresponding to the total delivery rate of the first hydraulic pump 2 and the second hydraulic pump 3 to achieve boom raising.

After completion of boom raising, the dead weight of the front work implement 104 including the boom 106, the arm 107, and the bucket 108 acts in the contraction direction of the boom cylinder 1 as an external load. Described herein is an action in a case where the lever of the operation lever device 54 is operated in the fine operation region in this state for boom lowering (pulling action of the boom cylinder 1).

The controller 56 receives operation signals and the like (step S210), and determines that the instruction of the operation lever device 54 is the pulling action of the boom cylinder 1 (determination of YES in step S220). Subsequently, the controller 56 determines that the lever operation amount lies within the fine operation region (determination of YES in step S240), and outputs a command signal corresponding to the fine operation region shown in FIGS. 5 and 6 to each of the discharge valve 32, the first hydraulic pump 2, and the recovery valve 44 (step S250).

As a result, the recovery valve 44 comes into the closed state. Moreover, the pump delivery volume of the first hydraulic pump 2 becomes 0, and the suction and delivery rates of the first hydraulic pump 2 become 0. Furthermore, the discharge valve 32 has an opening corresponding to the lever operation amount, and the cap chamber 1*e* and the hydraulic working oil tank 6 come to communicate with each other via the third flow path 13 and the discharge flow path 16.

Accordingly, the discharge rate to the recovery valve 44 becomes 0 as indicated by the solid line Cy3 in the fine operation region shown in FIGS. 5 and 6. Moreover, each of the discharge rate from the cap chamber 1*e* toward the first port 2*a* of the first hydraulic pump 2, and the supply rate from the first hydraulic pump 2 to the rod chamber 1*f* becomes 0 as indicated by the solid Cy2 in the fine operation region shown in FIGS. 5 and 6. Furthermore, hydraulic working oil at a flow rate corresponding to the lever operation amount is discharged from the cap chamber 1*e* to the hydraulic working oil tank 6 via the discharge valve 32 as indicated by the solid line Cy1 in the fine operation region shown in FIGS. 5 and 6. As a result, the boom cylinder 1 is contracted at a speed corresponding to the discharge rate to the discharge flow path 16 to perform boom lowering. The delivery rate of the first hydraulic pump 2 is 0, and therefore a necessary amount of hydraulic working oil is supplied from the charge pump 4 to the rod chamber 1*f* via the charge flow path 18.

In this case, the discharge rate from the cap chamber 1*e* toward the first port 2*a* of the first hydraulic pump 2 is 0, and hence the regeneration amount of the first hydraulic pump 2 becomes 0 as indicated by a solid line Wy in the fine operation region shown in FIGS. 5 and 6.

Next described is an action in a case where the lever is operated in the normal operation region. The controller 56 performs processing in steps S210 and S220 similarly to the operation in the fine operation region, and determines in step S240 that the lever operation amount does not lie within the fine operation region (NO). Subsequently, the controller 56 determines that each of the pump delivery volume and the regeneration amount of the first hydraulic pump 2 is not the maximum (determinations of NO in steps S260 and S270), and outputs a command signal corresponding to the normal operation region shown in FIGS. 5 and 6 to each of the discharge valve 32, the first hydraulic pump 2, and the recovery valve 44 (step S280).

As a result, the recovery valve 44 comes into the closed state. The opening of the discharge valve 32 becomes an opening corresponding to the lever operation amount. Moreover, the pump delivery volume of the first hydraulic pump 2 becomes a volume corresponding to the lever operation amount, and the suction and delivery rates of the first hydraulic pump 2 become flow rates corresponding to the lever operation amount.

Accordingly, the discharge rate to the recovery valve 44 becomes 0 as indicated by the solid line Cy3 in the normal operation region shown in FIGS. 5 and 6. Moreover, hydraulic working oil at a flow rate corresponding to the lever operation amount is discharged from the cap chamber 1*e* to the hydraulic working oil tank 6 via the discharge valve 32 as indicated by the solid line Cy1 in the normal operation region shown in FIGS. 5 and 6. Furthermore, as indicated by the solid line Cy2 in the normal operation region shown in FIGS. 5 and 6, hydraulic working oil at a flow rate corresponding to the lever operation amount is discharged from the cap chamber 1*e* toward the first port 2*a* side of the first hydraulic pump 2, while hydraulic working oil at a flow rate corresponding to the lever operation amount is supplied from the first hydraulic pump 2 to the rod chamber 1*f*. Accordingly, the boom cylinder 1 is contracted at a speed corresponding to the discharge rate to the discharge valve 32 and the suction rate of the first hydraulic pump 2 to perform boom lowering.

In this case, a flow corresponding to the lever operation amount is discharged from the cap chamber 1*e* toward the first port 2*a* side of the first hydraulic pump 2, whereby the first hydraulic pump 2 performs regenerative driving. Accordingly, the regeneration amount of the first hydraulic pump 2 is an amount corresponding to the lever operation amount as indicated by the solid line Wy in the normal operation region shown in FIGS. 5 and 6.

Described next is an action in a case where the lever operation amount is increased from the normal operation region to a region where the pump delivery volume of the first hydraulic pump 2 reaches the maximum (high-speed operation region). The controller 56 performs processing in steps S210, S220, and S240 similarly to the operation in the normal operation region. Subsequently, the process proceeds to step S260, where it is determined that the pump delivery volume of the first hydraulic pump 2 is the maximum (YES). A command signal corresponding to the high-speed operation region shown in FIG. 5 is output to each of the discharge valve 32, the first hydraulic pump 2, and the recovery valve 44 (step S290).

As a result, the opening of the discharge valve 32 becomes an opening corresponding to the lever operation amount. Moreover, the pump delivery volume of the first hydraulic pump 2 is the maximum, and the suction and delivery rates of the first hydraulic pump 2 are the maximum. Furthermore, the recovery valve 44 in the closed state is opened to a degree corresponding to an increase amount of the lever operation amount, whereby connection is made between the cap chamber 1*e* and the rod chamber 1*f* via the recovery flow path 29.

Accordingly, hydraulic working oil at a flow rate corresponding to the lever operation amount is discharged from the cap chamber 1*e* to the hydraulic working oil tank 6 via the discharge valve 32 as indicated by the solid line Cy1 in the high-speed operation region shown in FIG. 5. Furthermore, as indicated by the solid line Cy2 in the high-speed operation region shown in FIG. 5, hydraulic working oil at a flow rate corresponding to maximum suction rate of the first hydraulic pump 2 is discharged from the cap chamber 1*e* toward the first port 2*a* side of the first hydraulic pump 2, while hydraulic working oil at a flow rate corresponding to the maximum delivery rate of the first hydraulic pump 2 is supplied from the first hydraulic pump 2 to the rod chamber 1*f*. In addition, hydraulic working oil at a flow rate corresponding to the lever operation amount flows from the cap chamber 1*e* into the rod chamber 1*f* via the recovery flow path 29 as indicated by the solid line Cy3 in the high-speed operation region shown in FIG. 5. As a result, the boom cylinder 1 is contracted at a speed corresponding to the discharge rate from the cap chamber 1*e* to the recovery flow path 29 in addition to the discharge rate to the discharge valve 32 and the suction rate of the first hydraulic pump 2 to perform boom lowering.

In this case, the discharge rate from the cap chamber 1*e* toward the first port 2*a* side of the first hydraulic pump 2 (suction rate of first hydraulic pump 2) becomes constant regardless of the lever operation amount, and therefore the regeneration amount of the first hydraulic pump 2 also becomes constant regardless of the lever operation amount as indicated by the solid line Wy in the high-speed operation region shown in FIG. 5.

Further described is an action in a case where the lever operation amount is increased from the normal operation region to a region where the regeneration amount of the first hydraulic pump 2 reaches the maximum (high-speed operation region). The controller 56 performs processing in steps S210, S220, and S240 similarly to the operation in the normal operation region, and determines in step S260 that the pump delivery volume of the first hydraulic pump 2 is not the maximum (NO). Subsequently, the controller 56 determines that the regeneration amount of the first hydraulic pump 2 is the maximum (determination of YES in step S270), and outputs a command signal corresponding to the high-speed operation region shown in FIG. 6 to each of the discharge valve 32, the first hydraulic pump 2, and the recovery valve 44 (step S290).

As a result, the opening of the discharge valve 32 becomes an opening corresponding to the lever operation amount. Moreover, the pump delivery volume of the first hydraulic pump 2 becomes a volume in a case where the regeneration amount is the maximum, and the suction and delivery rates of the first hydraulic pump 2 become flow rates for a case in which the regeneration amount is the maximum. Furthermore, the recovery valve 44 in the closed state is opened to a degree corresponding to the lever operation amount, whereby connection is made between the cap chamber 1*e* and the rod chamber 1*f* via the recovery flow path 29.

Accordingly, hydraulic working oil at a flow rate corresponding to the lever operation amount is discharged from the cap chamber 1*e* to the hydraulic working oil tank 6 via the discharge valve 32 as indicated by the solid line Cy1 in the high-speed operation region shown in FIG. 6. Furthermore, as indicated by the solid line Cy2 in the high-speed operation region shown in FIG. 6, hydraulic working oil at a flow rate for a case in which the regeneration amount is the maximum is discharged from the cap chamber 1*e* toward the first port 2*a* of the first hydraulic pump 2, while hydraulic working oil at a flow rate for a case in which the regeneration amount is the maximum is supplied from the first hydraulic pump 2 to the rod chamber 1*f*. In addition, hydraulic working oil at a flow rate corresponding to the lever operation amount flows from the cap chamber 1*e* into the rod chamber 1*f* via the recovery flow path 29 as indicated by the solid line Cy3 in the high-speed operation region shown in FIG. 6. As a result, the boom cylinder 1 is contracted at a speed corresponding to the discharge rate from the cap chamber 1*e* to the recovery flow path 29 in addition to the discharge rate to the discharge valve 32 and the suction rate of the first hydraulic pump 2 to perform boom lowering. In this case, the regeneration amount of the first hydraulic pump 2 is the maximum as indicated by the solid line Wy in the high-speed operation region shown in FIG. 6.

In the construction machine according to Embodiment 1 of the present invention as described above, the discharge valve 32 and the first hydraulic pump 2 are controlled such that the whole amount of the hydraulic working oil discharged from the cap chamber 1*e* of the boom cylinder 1 is discharged to the discharge flow path 16 without discharge to the first hydraulic pump 2 at the time of fine operation of the pulling action of the boom cylinder 1 in the state that an external load is applied in the contraction direction of the boom cylinder 1. In this case, the action speed of the boom cylinder 1 at the time of fine operation can be controlled not by the suction and delivery rates of the first hydraulic pump 2, but by the discharge rate from the cap chamber 1*e* to the discharge flow path 16. In other words, the action speed of the boom cylinder 1 is adjustable to an extremely slow speed only by using the discharge valve 32 capable of performing more accurate flow rate control than a hydraulic pump unable to perform highly accurate flow rate control at an extremely low flow rate. Accordingly, operability during fine operation of the pulling action of the boom cylinder 1 in the state that an external load is applied in the contraction direction of the boom cylinder 1 improves more than a construction machine having a structure in which the action speed of the boom cylinder 1 is controlled by the suction and delivery rates of the hydraulic pump.

Moreover, in the present embodiment, a part of hydraulic working oil discharged from the cap chamber 1*e* is supplied to the rod chamber 1*f* via the recovery flow path 29 by controlling the recovery valve 44 when the pump delivery volume of the first hydraulic pump 2 reaches the maximum during the pulling action of the boom cylinder 1. Accordingly, the action speed of the boom cylinder 1 can increase without limitation by the maximum suction and delivery rates of the first hydraulic pump 2. In other words, the boom cylinder 1 can be driven at a high action speed requested by the operator without using a large-capacity hydraulic pump as the first hydraulic pump 2.

Furthermore, in the present embodiment, a part of hydraulic working oil discharged from the cap chamber 1*e* is supplied to the rod chamber 1*f* via the recovery flow path 29 by controlling the recovery valve 44 when the regeneration amount of the first hydraulic pump 2 reaches the maximum during the pulling action of the boom cylinder 1. In this case, the flow rate of the hydraulic working oil discharged from the cap chamber 1*e* can increase while limiting the flow rate of hydraulic working oil discharged from the cap chamber 1*e* to the first hydraulic pump 2 (suction rate of first hydraulic pump 2). Accordingly, the action speed of the boom cylinder 1 can increase while preventing excessive regeneration of the first hydraulic pump 2.

Embodiment 2

Figure 8:
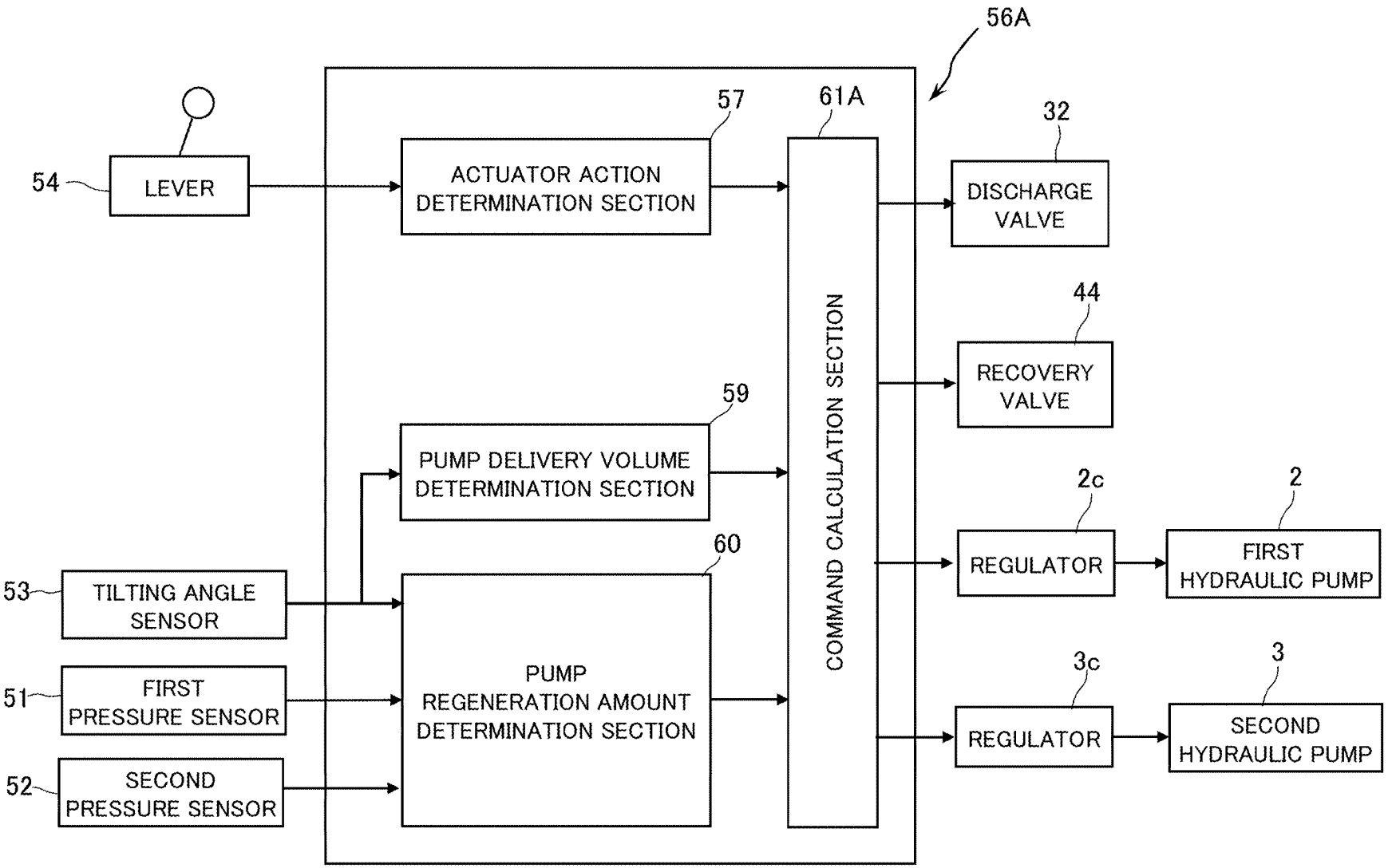
FIG. 8 is a block diagram showing functions of a controller constituting a construction machine according to Embodiment 2 of the present invention.
Figure 9:
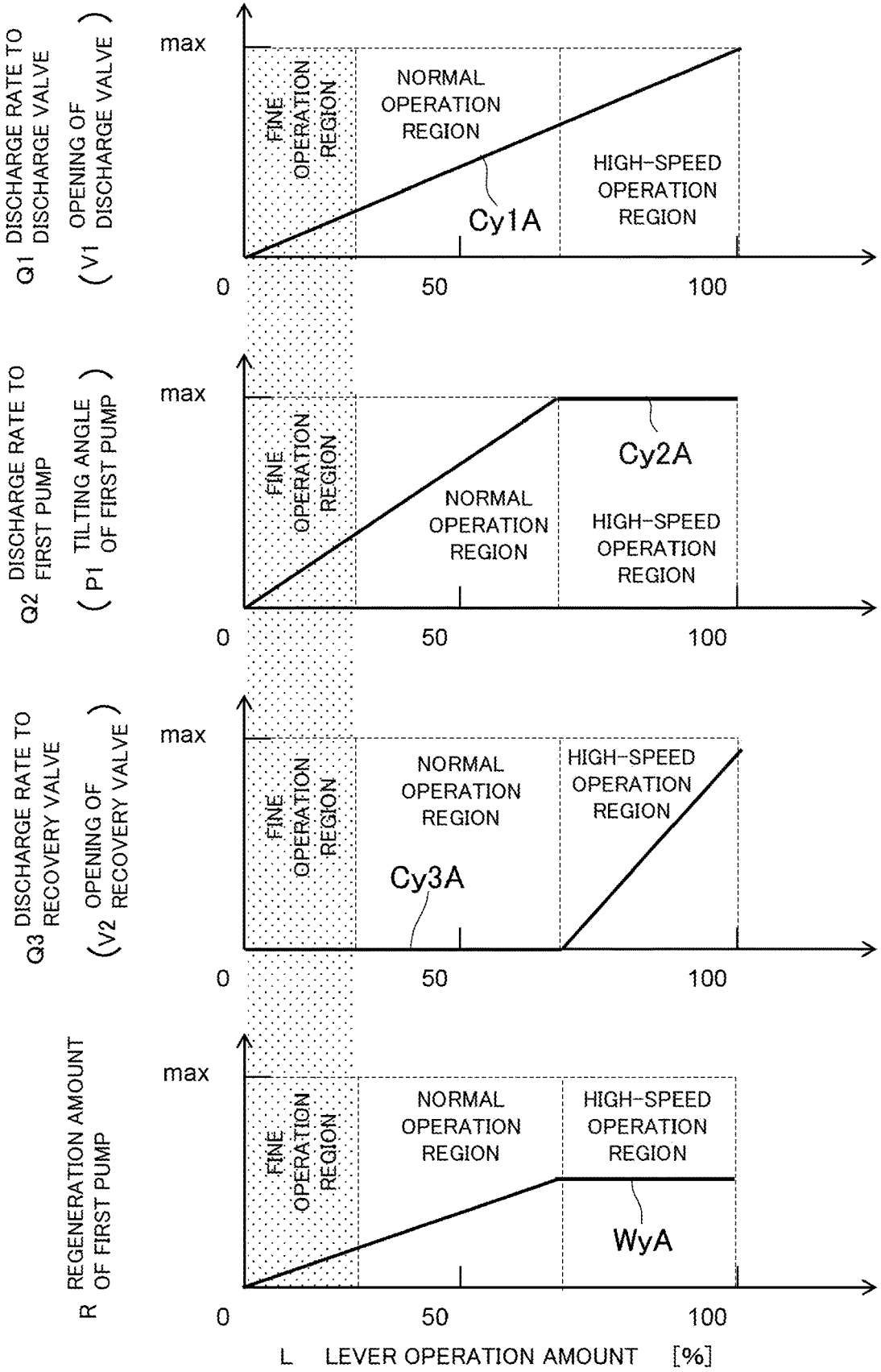
FIG. 9 is a characteristic diagram showing an example of a control method performed by the controller constituting the construction machine according to Embodiment 2 of the present invention for a discharge valve, a first hydraulic pump, and a recovery valve at the time of a pulling action of a boom cylinder (boom lowering), and is a diagram in a case where a pump delivery volume of the first hydraulic pump reaches the maximum before an operation amount becomes the maximum.
Figure 10:
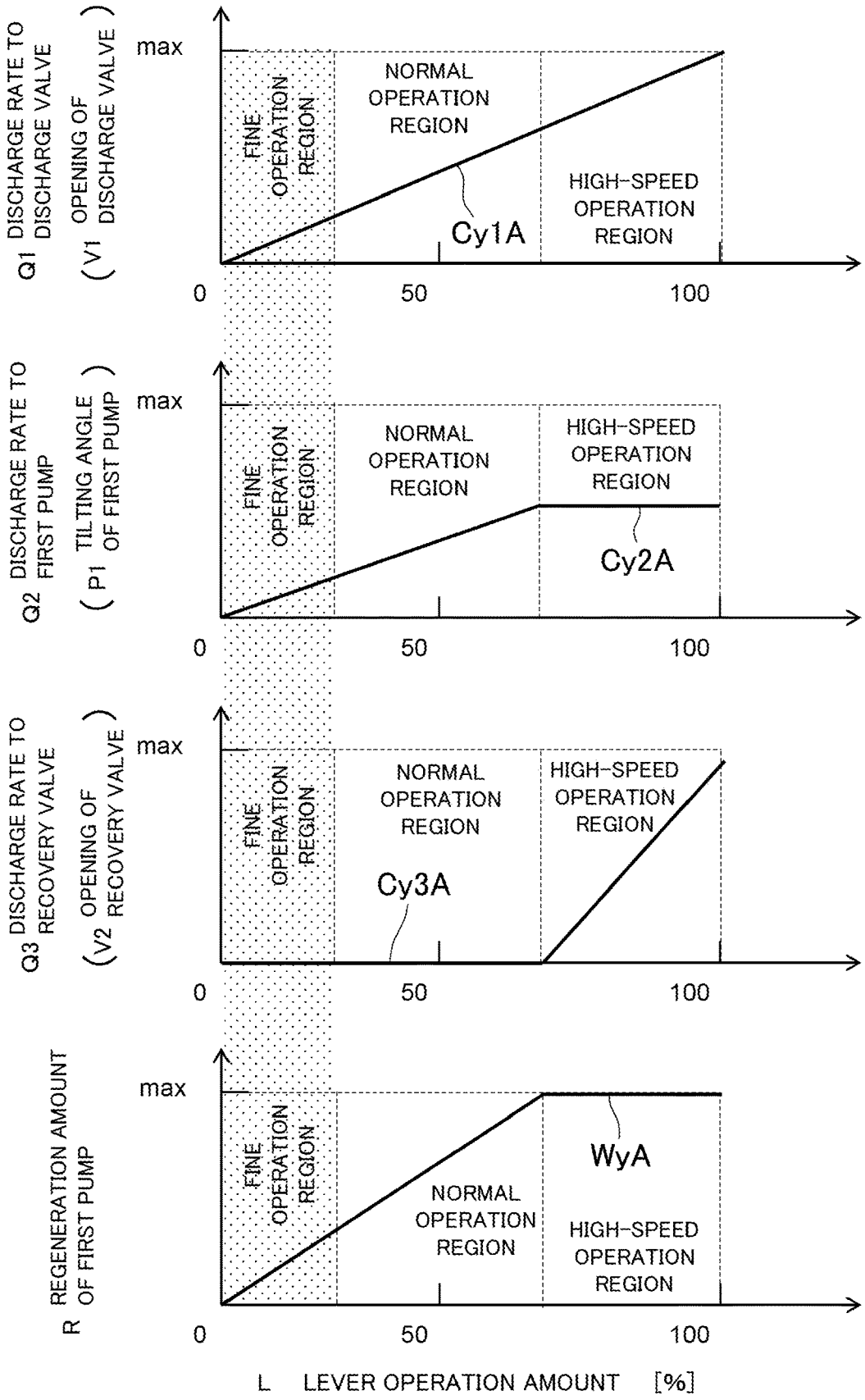
FIG. 10 is a characteristic diagram showing an example of a control method performed by the controller constituting the construction machine according to Embodiment 2 of the present invention for the discharge valve, the first hydraulic pump, and the recovery valve at the time of the pulling action of the boom cylinder (boom lowering), and is a diagram in a case where a regeneration amount of the first hydraulic pump reaches the maximum before the operation amount becomes the maximum.
Figure 11:
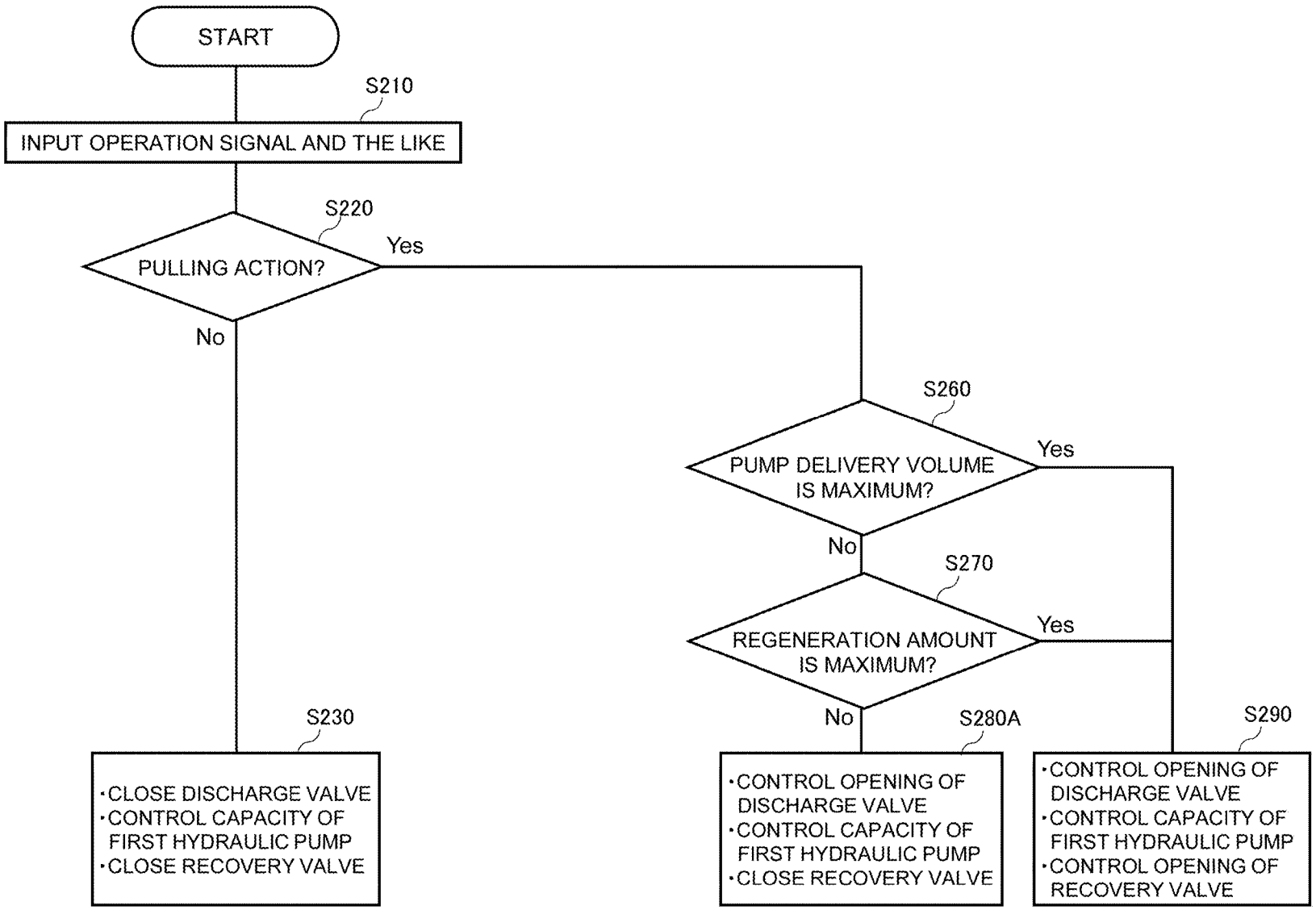
FIG. 11 is a flowchart showing an example of control procedures performed by the controller constituting the construction machine according to Embodiment 2 of the present invention.

A construction machine according to Embodiment 2 of the present invention is now described with reference to FIGS. 8 to 11. FIG. 8 is a block diagram showing functions of a controller constituting the construction machine according to Embodiment 2 of the present invention. FIG. 9 is a characteristic diagram showing an example of a control method performed by the controller according to Embodiment 2 for the discharge valve, the first hydraulic pump, and the recovery valve at the time of the pulling action of the boom cylinder (boom lowering), in a case where the pump delivery volume of the first hydraulic pump reaches the maximum before the operation amount becomes the maximum. FIG. 10 is a characteristic diagram showing an example of a control method performed by the controller according to Embodiment 2 for the discharge valve, the first hydraulic pump, and the recovery valve at the time of the pulling action of the boom cylinder (boom lowering), in a case where the regeneration amount of the first hydraulic pump reaches the maximum before the operation amount becomes the maximum. FIG. 11 is a flowchart showing an example of control procedures performed by the controller according to Embodiment 2. Parts in FIGS. 8 to 11 identical to parts in FIGS. 1 to 7 are given identical reference numbers, and detailed description of the identical parts is not repeated herein.

The construction machine according to Embodiment 2 of the present invention is different from the construction machine according to Embodiment 1 in a point that a controller 56A of Embodiment 2 does not adjust the pump delivery volume (suction and delivery rates) of the first hydraulic pump 2 to 0, but controls the pump delivery volume in accordance with the lever operation amount during fine operation of boom lowering in the state that an external load is applied in the contraction direction of the boom cylinder 1 unlike in Embodiment 1. Under this control, a part of hydraulic working oil discharged from the cap chamber 1*e* is discharged to the hydraulic working oil tank 6 via the discharge flow path 16, and the remained hydraulic working oil is discharged toward the first port 2*a* side of the first hydraulic pump 2. Accordingly, the action speed of the boom cylinder 1 becomes a speed corresponding to the total flow rate of the discharge rate to the discharge valve 32 and the suction rate of the first hydraulic pump 2.

More specifically, the controller 56A does not have the lever operation region determination section 58 included in the controller 56 of Embodiment 1 as shown in FIG. 8. Accordingly, the controller 56A does not determine whether or not the lever operation amount of the operation lever device 54 lies within the fine operation region.

Next described are details of control performed by a command calculation section 61A of the controller 56A for the discharge valve, the first hydraulic pump, and the recovery valve when the lever operation lies within the fine operation region for boom lowering. Control performed by the controller 56A for the discharge valve 32 is similar to the corresponding control by the controller 56 according to Embodiment 1 as indicated by a solid line Cy1A in FIGS. 9 and 10 (see solid line Cy1 in FIGS. 5 and 6). In addition, control performed by the controller 56A for the recovery valve 44 is similar to the corresponding control by the controller 56 according to Embodiment 1 as indicated by a solid line Cy3A in FIGS. 9 and 10 (see solid line Cy3 in FIGS. 5 and 6).

On the other hand, control performed by the controller 56A for the first hydraulic pump 2 increases the tilting angle of the swash plate of the first hydraulic pump 2 in accordance with an increase in the lever operation amount until the pump delivery volume or the regeneration amount of the first hydraulic pump 2 reaches the maximum (up to the range of fine operation region and normal operation region) as indicated by a solid line Cy2A in FIGS. 9 and 10. In other words, the controller 56A controls the delivery volume of the first hydraulic pump 2 such that the discharge rate from the cap chamber 1*e* to the first hydraulic pump 2 and the supply rate from the first hydraulic pump 2 to the rod chamber 1*f* (suction and delivery rates of first hydraulic pump 2) increase in accordance with an increase in the lever operation amount. The control performed by the controller 56A for the first hydraulic pump 2 in a case in which the pump delivery volume or regeneration amount of the first hydraulic pump 2 is the maximum is similar to the corresponding control by the controller 56 according to Embodiment 1 (see solid line Cy2 in FIGS. 5 and 6).

as described above, in the present embodiment, the controller 56A controls the discharge valve 32, the first hydraulic pump 2, and the recovery valve 44 such that a part of hydraulic working oil discharged from the cap chamber 1*e* is discharged to the discharge flow path 16 in accordance with the lever operation amount, and that the remained hydraulic working oil is discharged toward the first port 2*a* side of the first hydraulic pump 2 when the lever operation amount lies in any range within the fine operation region.

Next described with reference to FIG. 11 is a control flow performed by the controller 56A according to Embodiment 2 to achieve boom lowering in a state that an external load is applied in the contraction direction of the boom cylinder 1. The control flow performed by the controller 56A according to Embodiment 2 is different from the control flow performed by the controller 56 according to Embodiment 1 (see FIG. 7) in a following point. First, "determining whether or not the lever operation amount lies within the fine operation region" corresponding to step S240 in Embodiment 1 is not required. Second, with elimination of step S240, subsequent step S250 of Embodiment 1 (corresponding to control process for the discharge valve 32 and the like when the lever operation amount lies within the fine operation region) is also eliminated. Accordingly, the control performed by the controller 56A for the discharge valve 32 and the like in the case where the lever operation amount lies within the fine operation region is performed in step S280A.

Next described with reference to FIGS. 9 to 11 is an action at the time of boom lowering of the construction machine according to Embodiment 2 of the present invention. Only an action in the case where the lever operation amount lies within the fine operation region is described herein. Description of actions in the case where the lever operation amount lies within the normal operation region, the case where the pump delivery volume of the first hydraulic pump 2 reaches the maximum (high-speed operation region), and the case where the regeneration amount of the first hydraulic pump 2 reaches the maximum (high-speed operation region) is similar to the corresponding description of Embodiment 1, wherefore the same description is not repeated herein.

When the lever operation amount lies within the fine operation region, the controller 56A performs processing in steps S210, S220, S260, and S270 shown in FIG. 11. The command calculation section 61A outputs a command signal corresponding to the fine operation region in FIGS. 9 and 10 to each of the discharge valve 32, the first hydraulic pump 2, and the recovery valve 44 (step S280A).

In this case, the recovery valve 44 is in the closed state and the opening of the discharge valve 2 is an opening corresponding to the lever operation amount as in Embodiment 1. On the other hand, unlike Embodiment 1, the pump delivery volume of the first hydraulic pump 2 becomes a volume corresponding to the lever operation amount, and the suction and delivery rates of the first hydraulic pump 2 become flow rates corresponding to the lever operation amount.

Accordingly, the discharge rate to the recovery valve 44 becomes 0 as indicated by the solid line Cy3A in the fine operation region shown in FIGS. 9 and 10 as in Embodiment 1. In addition, hydraulic working oil is discharged from the cap chamber 1*e* to the hydraulic working oil tank 6 via the discharge valve 32 at a flow rate corresponding to the lever operation amount as indicated by the solid line Cy1A in the fine operation region shown in FIGS. 9 and 10. On the other hand, unlike Embodiment 1, hydraulic working oil is discharged from the cap chamber 1*e* toward the first port 2*a* side of the first hydraulic pump 2 at a flow rate corresponding to the lever operation amount, and hydraulic working oil is supplied from the first hydraulic pump 2 to the rod chamber 1*f* at a flow rate corresponding to the lever operation amount as indicated by the solid line Cy2A in the fine operation region shown in FIGS. 9 and 10. Accordingly, the boom cylinder 1 is contracted at a speed corresponding to the discharge rate to the discharge valve 32 and the suction rate of the first hydraulic pump 2 to perform boom lowering.

In the present embodiment, a flow rate corresponding to the lever operation amount is discharged from the cap chamber 1*e* toward the first port 2*a* side of the first hydraulic pump 2 to perform regenerative driving of the first hydraulic pump even when the lever operation amount lies within the fine operation region. Accordingly, the regeneration amount of the first hydraulic pump 2 becomes an amount corresponding to the lever operation amount as indicated by a solid line WyA in the fine operation region shown in FIGS. 9 and 10.

In Embodiment 2 described above, the discharge valve 32 and the first hydraulic pump 2 are controlled such that a part of hydraulic working oil discharged from the cap chamber 1*e* of the boom cylinder 1 is discharged to the discharge flow path 16, and that the remained hydraulic working oil is discharged toward the first port 2*a* of the first hydraulic pump 2 at the time of fine operation of the pulling action of the boom cylinder 1 in the state that an external load is applied in the contraction direction of the boom cylinder 1. In this case, the action speed of the boom cylinder 1 during fine operation is controllable using the discharge valve 32 capable of performing more accurate control of an extremely low flow rate than control by a hydraulic pump. Accordingly, operability during fine operation of the pulling action of the boom cylinder 1 improves more than a construction machine having a structure in which the action speed of the boom cylinder 1 is controlled by the suction and delivery rates of the hydraulic pump.

Moreover, in the present embodiment, even when the lever operation amount lies within the fine operation region, the first hydraulic pump 2 is controlled to perform regenerative driving as in the case of operation in the normal operation region. Accordingly, more regenerative energy can be produced in comparison with Embodiment 1.

Embodiment 3

Figure 12:
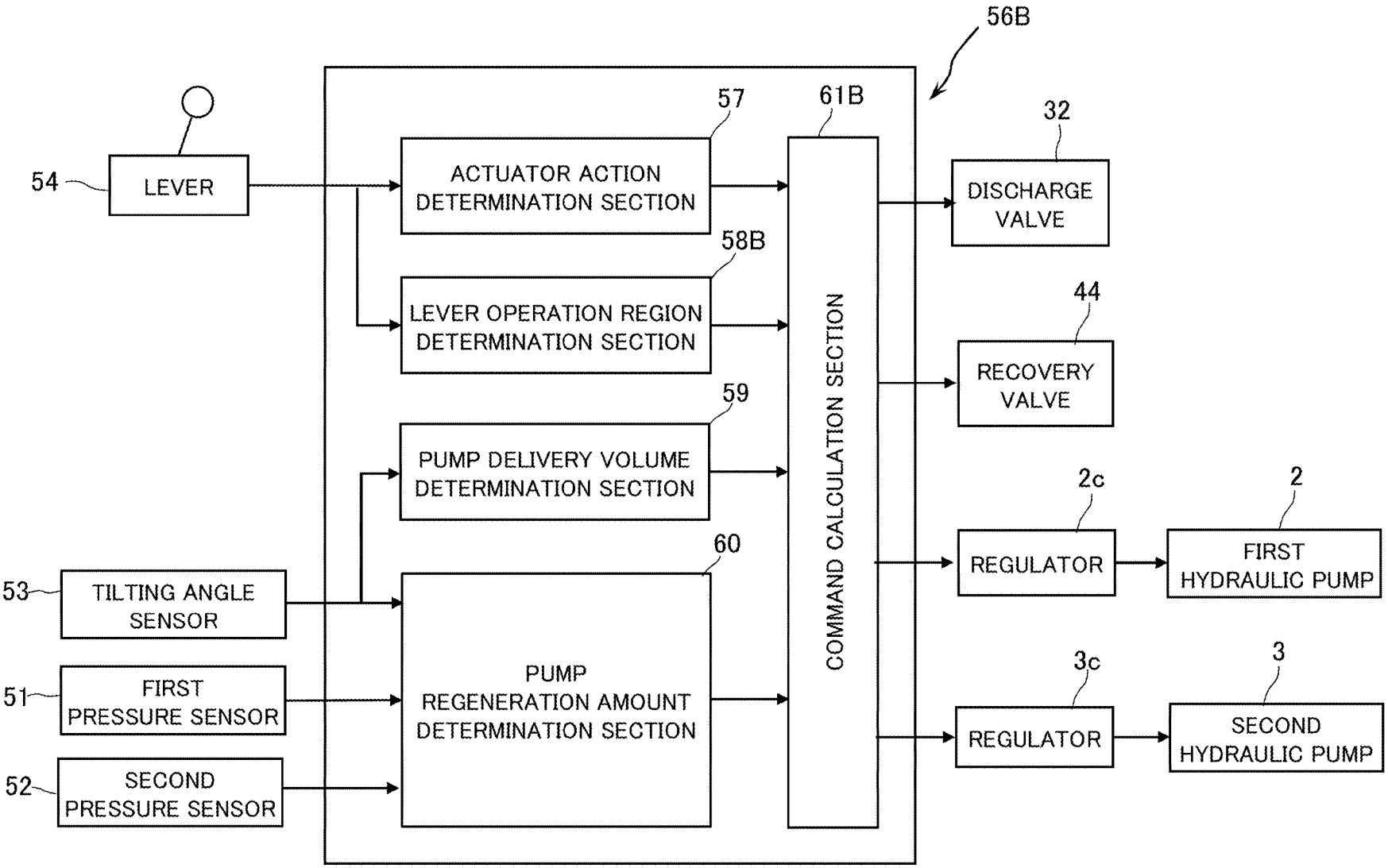
FIG. 12 is a block diagram showing functions of a controller constituting a construction machine according to Embodiment 3 of the present invention.
Figure 13:
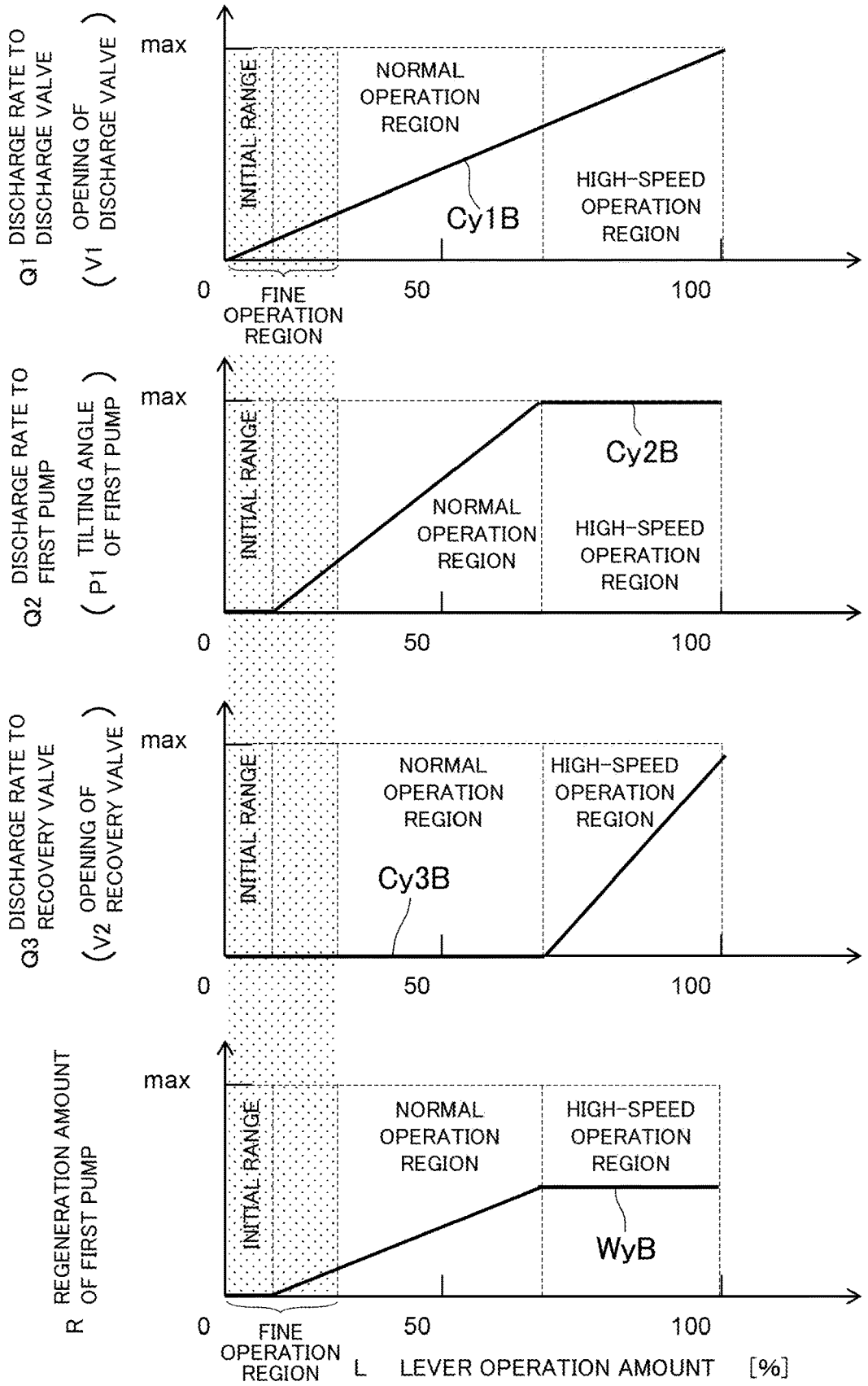
FIG. 13 is a characteristic diagram showing an example of a control method performed by the controller constituting the construction machine according to Embodiment 3 of the present invention for a discharge valve, a first hydraulic pump, and a recovery valve at the time of a pulling action of a boom cylinder (boom lowering), and is a diagram in a case where a pump delivery volume of the first hydraulic pump reaches the maximum before an operation amount becomes the maximum.
Figure 14:
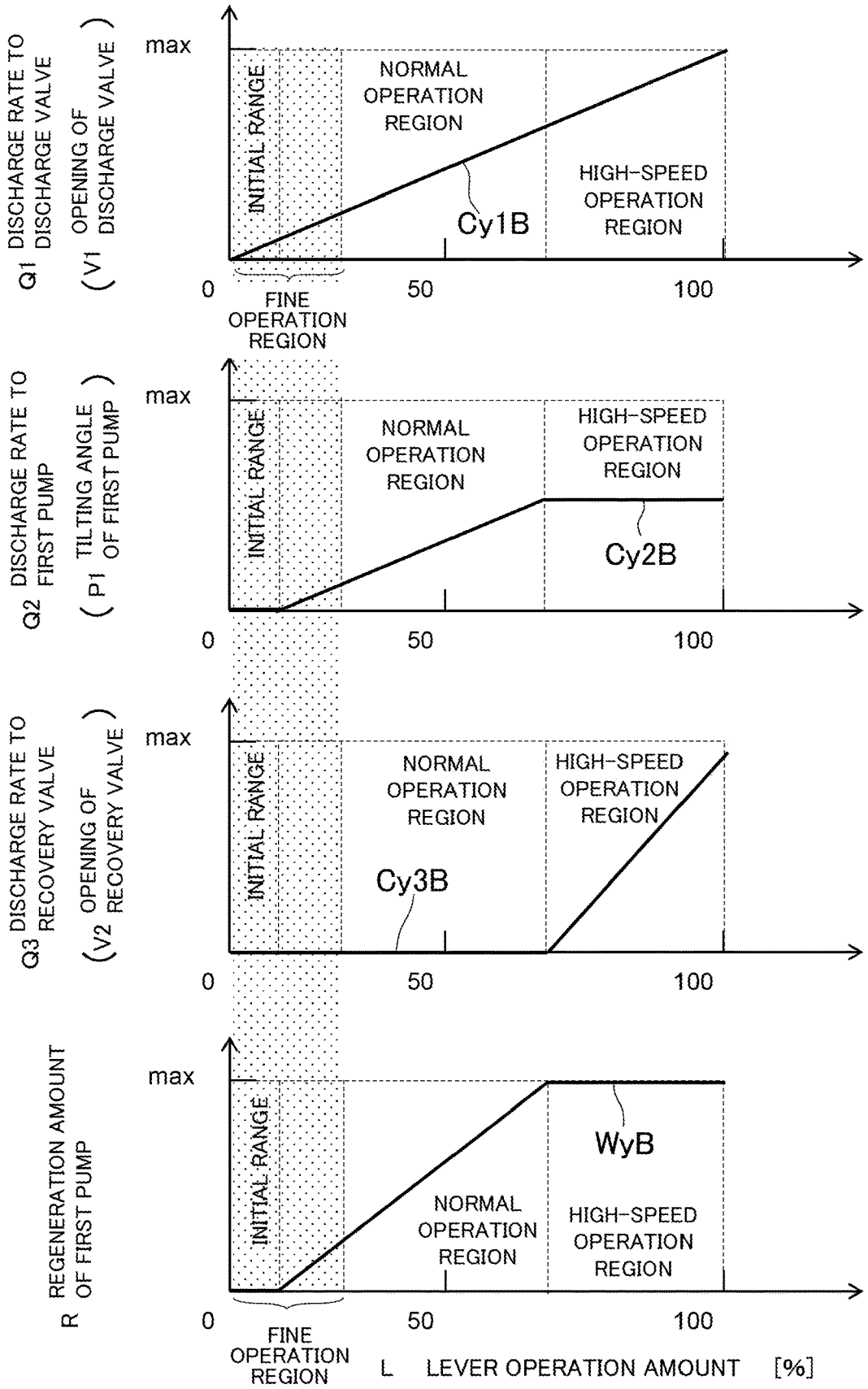
FIG. 14 is a characteristic diagram showing an example of a control method performed by the controller constituting the construction machine according to Embodiment 3 of the present invention for the discharge valve, the first hydraulic pump, and the recovery valve at the time of the pulling action of the boom cylinder (boom lowering), and is a diagram in a case where a regeneration amount of the first hydraulic pump reaches the maximum before the operation amount becomes the maximum.
Figure 15:
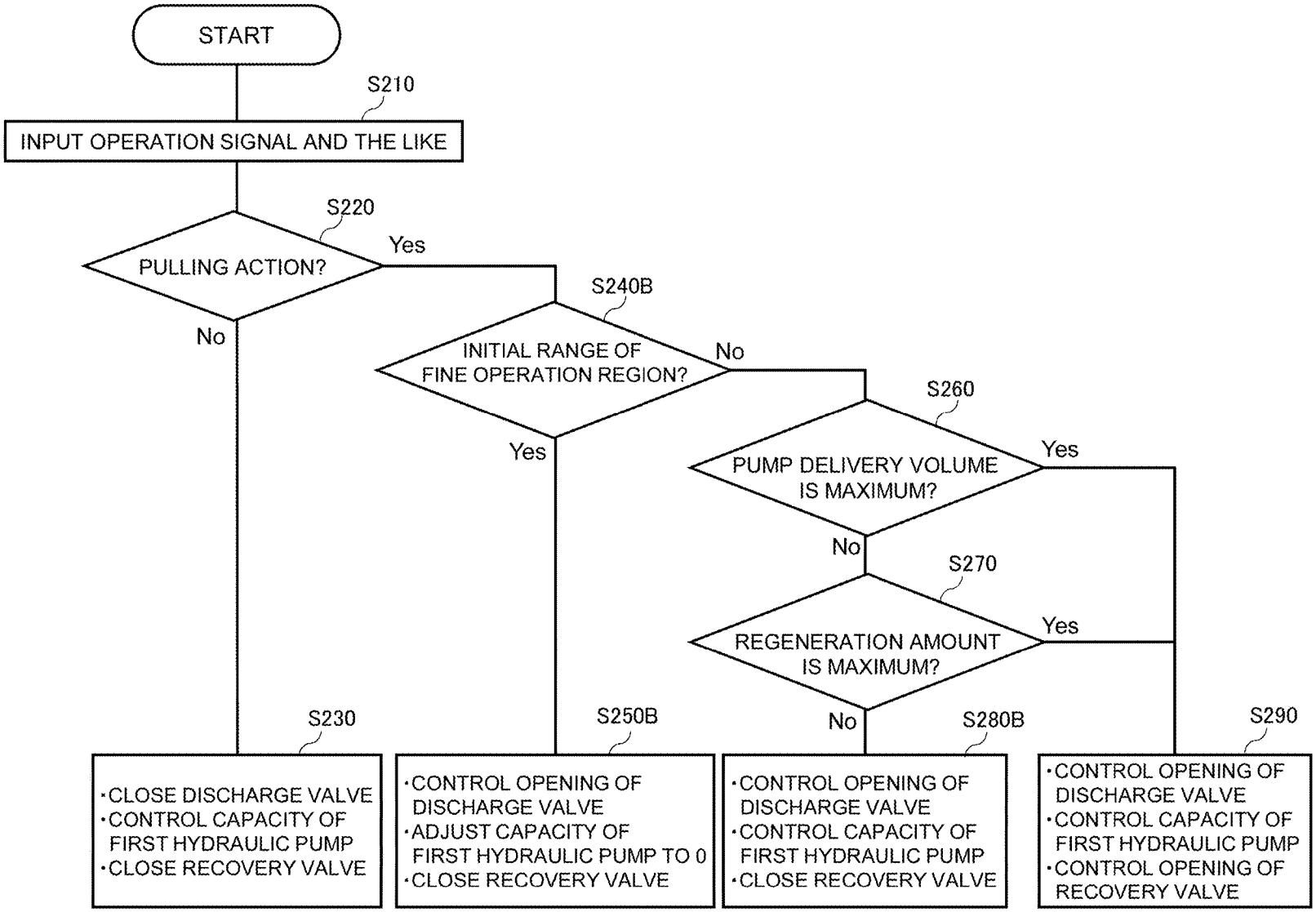
FIG. 15 is a flowchart showing an example of control procedures performed by the controller constituting the construction machine according to Embodiment 3 of the present invention.

A construction machine according to Embodiment 3 of the present invention is now described with reference to FIGS. 12 to 15. FIG. 12 is a block diagram showing functions of a controller constituting the construction machine according to Embodiment 3 of the present invention. FIG. 13 is a characteristic diagram showing an example of a control method performed by the controller according to Embodiment 3 for the discharge valve, the first hydraulic pump, and the recovery valve at the time of the pulling action of the boom cylinder (boom lowering), in a case where the pump delivery volume of the first hydraulic pump reaches the maximum before the operation amount becomes the maximum. FIG. 14 is a characteristic diagram showing an example of a control method performed by the controller according to Embodiment 3 for the discharge valve, the first hydraulic pump, and the recovery valve at the time of the pulling action of the boom cylinder (boom lowering), in a case where the regeneration amount of the first hydraulic pump reaches the maximum before the operation amount becomes the maximum. FIG. 15 is a flowchart showing an example of control procedures performed by the controller according to Embodiment 3. Parts in FIGS. 12 to 15 identical to parts in FIGS. 1 to 11 are given identical reference numbers, and detailed description of the identical parts is not repeated herein.

The construction machine according to Embodiment 3 of the present invention is different from the construction machine of Embodiment 1 in a point that a controller 56B of Embodiment 3 does not adjust the pump delivery volume (suction and delivery rates) of the first hydraulic pump 2 to 0, unlike in Embodiment 1, but controls the pump delivery volume in accordance with the lever operation amount in a region where the lever operation amount exceeds an initial range within the fine operation region during fine operation of boom lowering in the state that an external load is applied in the contraction direction of the boom cylinder 1. The initial range of the fine operation region is a region where fine operability of the boom cylinder 1 is considered important. On the other hand, for example, the region exceeding the initial range within the fine operation region is a region where energy efficiency is considered more important than fine operability of the boom cylinder 1. For example, the initial range is set to a region where the proportion of the lever operation amount (operation angle) becomes approximately equal to or smaller than 10% of the whole operation region.

More specifically, a lever operation region determination section 58B of the controller 56 shown in FIG. 12 determines whether or not the lever operation amount of the operation lever device 54 lies in the initial range within the fine operation region, unlike the lever operation region determination section 58 of the controller 56 of Embodiment 1.

Next described are details of control performed by a command calculation section 61B of the controller 56B for the discharge valve, the first hydraulic pump, and the recovery valve in a case where the lever operation lies within the fine operation region of boom lowering. Control performed by the controller 56B for the discharge valve 32 is similar to the corresponding control by the controller 56 according to Embodiment 1 as indicated by a solid line Cy1B in FIGS. 13 and 14 (see solid line Cy1 in FIGS. 5 and 6). In addition, control performed by the controller 56B for the recovery valve 44 is similar to the corresponding control by the controller 56 according to Embodiment 1 as indicated by a solid line Cy3B in FIGS. 13 and 14 (see solid line Cy3 in FIGS. 5 and 6).

On the other hand, as indicated by a solid line Cy2B in FIGS. 13 and 14, the control performed by the controller 56B for the first hydraulic pump 2 adjusts the tilting angle of the swash plate to 0 regardless of the lever operation amount in a state that the lever operation amount lies within the initial range of the fine operation region, and increases the tilting angle of the swash plate in accordance with an increase in the lever operation amount in a region where the lever operation amount exceeds the initial range within the fine operation region. In other words, the controller 56B controls the delivery volume of the first hydraulic pump 2 within the initial range of the fine operation region such that the discharge rate from the cap chamber 1*e* to the first hydraulic pump 2 and the supply rate from the first hydraulic pump 2 to the rod chamber 1*f* (suction and delivery rates of first hydraulic pump 2) become 0 regardless of the lever operation amount. On the other hand, in the region beyond the initial range within the fine operation region, the controller 56B controls the pump delivery volume of the first hydraulic pump 2 such that the suction and delivery rates of the first hydraulic pump 2 increase in accordance with an increase in the lever operation amount.

In the present embodiment, the controller 56B controls the discharge valve 32, the first hydraulic pump 2, and the recovery valve 44 such that the entire amount of hydraulic working oil discharged from the cap chamber 1*e* is discharged to the discharge flow path 16 when the operation amount lies within the initial range of the fine operation region. Moreover, when the operation amount exceeds the initial range within the fine operation region, the controller 56B controls the discharge valve 32, the first hydraulic pump 2, and the recovery valve 44 such that a part of hydraulic working oil discharged from the cap chamber 1*e* is discharged to the discharge flow path 16 in accordance with the lever operation amount, and that the remained hydraulic working oil is discharged toward the first port 2*a* side of the first hydraulic pump 2.

Next described with reference to FIG. 15 is a control flow performed by the controller 56B according to Embodiment 3 to achieve boom lowering in a state that an external load is applied in the contraction direction of the boom cylinder 1. The control flow of the controller 56B according to Embodiment 3 includes step S240B "determining whether or not the lever operation amount lies within the initial range of the fine operation region" in place of step S240 "determining whether or not the lever operation amount lies within the fine operation region" in the control flow of the controller 56 according to Embodiment 1 (see FIG. 7). Accordingly, control by the controller 56B for the discharge valve 32 and the like in step S250B subsequent to step S240B is performed only when the lever operation amount lies within the initial range of the fine operation region. In addition, the control by the controller 56B for the discharge valve 32 and the like in the case where the lever operation amount exceeds the initial range within the fine operation region is executed in step S280B.

Next described with reference to FIGS. 13 to 15 is an action at the time of boom lowering of the construction machine according to Embodiment 3 of the present invention. Only an action in the case where the lever operation amount lies within the fine operation region is described herein. Description of the action performed when the lever operation amount exceeds the fine operation region is similar to the corresponding description in Embodiment 1, wherefore the same description is not repeated herein.

When the lever operation amount lies within the initial range of the fine operation region, the controller 56B performs processing in steps S210 and S220 shown in FIG. 15. The lever operation region determination section 58B of the controller 56B determines in S240B that the operation amount lies in the initial range of the fine operation region (YES). Subsequently, the command calculation section 61B of the controller 56B outputs a command signal corresponding to the initial range of the fine operation region in FIGS. 13 and 14 to each of the discharge valve 32, the first hydraulic pump 2, and the recovery valve 44 (step S250B). In this case, control for the discharge valve 32, the first hydraulic pump 2, and the recovery valve 44 is similar to the corresponding control in Embodiment 1, wherefore the action of the hydraulic drive system is similar to that action of Embodiment 1.

On the other hand, when the lever operation amount exceeds the initial range within the fine operation region, the controller 56B determines in S240B that the operation amount does not lie within the initial range of the fine operation region (NO), and determines that each of the pump delivery volume and the regeneration amount of the first hydraulic pump 2 is not the maximum (NO in steps S260 and S270). Subsequently, the command calculation section 61B outputs a command signal, which corresponds to the region exceeding the initial range within the fine operation region, to the discharge valve 32, the first hydraulic pump 2, and the recovery valve 44 (step S280B).

As a result, the recovery valve 44 is closed, and the flow rate of the hydraulic working oil flowing in the recovery flow path 29 becomes 0 as in the case where the lever operation amount lies within the initial range of the fine operation region. Moreover, the opening of the discharge valve 32 becomes an opening corresponding to the lever operation amount, and hence hydraulic working oil is discharged from the cap chamber 1*e* to the hydraulic working oil tank 6 at a flow rate corresponding to the lever operation amount. On the other hand, unlike in the case where the operation amount lies within the initial range of the fine operation region, hydraulic working oil is discharged from the cap chamber 1*e* toward the first port 2*a* side of the first hydraulic pump 2 at a flow rate corresponding to the lever operation amount, and hydraulic working oil is supplied from the first hydraulic pump 2 to the rod chamber 1*f* at a flow rate corresponding to the lever operation amount as indicated by the solid line Cy2B in the region exceeding the initial range within the fine operation region in FIGS. 13 and 14. Accordingly, the action speed of the boom cylinder 1 is controlled by the discharge rate to the discharge flow path 16 and the suction rate of the first hydraulic pump 2.

In the present embodiment, a flow rate corresponding to the lever operation amount is discharged from the cap chamber 1*e* toward the first port 2*a* side of the first hydraulic pump 2 to perform regenerative driving of the first hydraulic pump 2 when the lever operation amount lies in the region exceeding the initial range within the fine operation region. Accordingly, the regeneration amount of the first hydraulic pump 2 becomes an amount corresponding to the lever operation amount as indicated by the solid line WyB in the region exceeding the initial range within the fine operation region shown in FIGS. 13 and 14.

In Embodiment 3 described above, when the operation amount lies within the initial range of the fine operation region, the discharge valve 32 and the first hydraulic pump 2 are controlled such that the whole amount of the hydraulic working oil discharged from the cap chamber 1*e* of the boom cylinder 1 is discharged to the discharge flow path 16 at the time of fine operation of the pulling action of the boom cylinder 1 in the state that an external load is applied in the contraction direction of the boom cylinder 1. In this case, the action speed of the boom cylinder 1 at the time of fine operation of the boom cylinder 1 is controllable only by using the discharge valve 32 capable of more accurately controlling an extremely low flow rate than a hydraulic pump. Accordingly, operability during fine operation of the pulling action of the boom cylinder 1 improves more than a configuration which controls the action speed of the boom cylinder 1 during fine operation only by using a hydraulic pump.

Moreover, in the present embodiment, when the operation amount lies in the range exceeding the initial range within the fine operation region, a part of hydraulic working oil discharged from the cap chamber 1*e* of the boom cylinder 1 is discharged to the discharge flow path 16 using the discharge valve 32, and the remained hydraulic working oil is discharged toward the first port 2*a* side of the first hydraulic pump 2. In this case, the action speed of the boom cylinder 1 during fine operation is controllable using both the discharge valve 32 and the first hydraulic pump 2. Accordingly, operability during fine operation of the pulling action of the boom cylinder 1 improves more than a configuration which controls the action speed of the boom cylinder 1 during fine operation only by using a hydraulic pump.

Moreover, in the present embodiment, the first hydraulic pump 2 is so controlled as to perform regenerative driving, unlike in the case where the operation amount lies within the initial range of the fine operation region, when the lever operation amount lies in the region exceeding the initial range within the fine operation region. Accordingly, more regenerative energy can be obtained than in Embodiment 1.

According to the construction machine of each of Embodiments 1 to 3 of the present invention as described above, at least a part of hydraulic working oil discharged from the cap chamber (first hydraulic working oil chamber) 1*e* of the boom cylinder (hydraulic cylinder) 1 is discharged to the discharge flow path 16 branched from the hydraulic closed circuit using the discharge valve 32 at the time of fine operation of the pulling action of the boom cylinder (hydraulic cylinder) 1 in the state that an external load is applied in the contraction direction of the boom cylinder (hydraulic cylinder) 1. In this case, the action speed of the boom cylinder (hydraulic cylinder) 1 during fine operation is controllable by the discharge valve 32. Accordingly, operability during fine operation of the pulling action of the boom cylinder (hydraulic cylinder) 1 improves in the state that an external load is applied in the contraction direction of the boom cylinder (hydraulic cylinder) 1.

Other Embodiments

While the hydraulic excavator 100 has been described as an example of the construction machine to which the present invention is applied in Embodiments 1 to 3 described above, the invention is applicable to a wide range of construction machines such as a wheel loader and a hydraulic crane.

The present invention is not limited to Embodiments 1 to 3 described above, but include various modifications. The embodiments detailed herein are presented only for easy understanding of the present invention, wherefore all configurations described herein are not necessarily required. For example, a part of a configuration of a certain embodiment may be replaced with a configuration of a different embodiment. Moreover, a configuration of a certain embodiment may be added to a configuration of a different embodiment. Furthermore, a part of a configuration of each of the embodiments may have an additional configuration, may be eliminated, or may be replaced.

For example, while a configuration example of the hydraulic drive system including the recovery flow path 29 and the recovery valve 44 has been presented in Embodiments 1 to 3 described above, a configuration of the hydraulic drive system from which the recovery flow path 29 and the recovery valve 44 are eliminated may be adopted.

According to the example presented in the embodiments described above, the fine operation region is a region where the proportion of the lever operation amount becomes approximately equal to or smaller than 25% of the whole operation region. However, the region may be any region where the proportion of the lever operation becomes equal to or smaller than 50% of the whole operation region or smaller. Moreover, an operation mode which extends the fine operation region to a region exceeding 50% of the whole operation region may be prepared as a mode giving priority to fine operation to increase a region for driving the boom cylinder 1 only by using the discharge valve 32.

According to the example presented in the embodiments described above, the recovery valve is opened when the pump delivery volume or the regeneration amount of the first hydraulic pump 2 reaches the maximum. However, the recovery valve may be opened when the pump delivery volume or the regeneration amount reaches a predetermined condition, such as 90% of the pump delivery volume or the regeneration amount of the first hydraulic pump 2.

According to the example presented in the embodiments described above, the discharge valve 32 is controlled by the controllers 56, 56A, and 56B such that a ratio (slope) of an increase amount of the discharge rate toward the discharge valve 32 to an increase amount of the lever operation amount becomes constant throughout the operation region from the fine operation region to the high-speed operation region (see Cy1 in FIGS. 5 and 6, Cy1A in FIGS. 9 and 10, and Cy1B in FIGS. 13 and 14). However, the slope of the discharge rate toward the discharge valve 32 to the lever operation amount in the normal operation region may be made smaller than each slope in other operation regions, for example. In this case, operability of the boom cylinder 1 in the normal operation region can be secured by increasing the slope of the discharge rate toward the first hydraulic pump 2 to the lever operation amount in the normal operation region by an amount corresponding to the foregoing decrease in the slope. Moreover, by increasing the slope of the discharge rate toward the first hydraulic pump 2 to the lever operation amount in the normal operation region, regenerative efficiency of the first hydraulic pump 2 in the normal operation region improves more than each regenerative efficiency of the embodiments described above.

According to the example presented in the embodiments described above, the discharge valve 32, the first hydraulic pump 2, and the recovery valve 44 are controlled by the controllers 56, 56A, and 56B such that a ratio (slope) of an increase amount of the total discharge rate of the boom cylinder 1 toward the discharge valve 32, the first hydraulic pump 2, and the recovery valve 44 to an increase amount of the lever operation amount becomes larger as the lever operation amount sifts from the fine operation region to the high-speed operation region through the normal operation region. For example, referring to FIGS. 5 and 6, the slope of the discharge rate toward the discharge valve 32 to the lever operation amount is constant throughout the operation region. On the other hand, the slope of the total discharge rate of the boom cylinder 1 in the normal operation region becomes larger than the slope of the total discharge rate (i.e. slope of discharge rate to discharge valve 32) in the fine operation region since discharge to the first hydraulic pump 2 starts in the normal operation region. In other words, acceleration of the boom cylinder 1 in the normal operation region becomes higher than acceleration in the fine operation region. Moreover, discharge to the recovery valve 44 starts in the high-speed operation region, and hence the slope of the total discharge rate of the boom cylinder 1 in the high-speed operation region becomes larger than the slope of the total discharge rate in the normal operation region. In other words, acceleration of the boom cylinder 1 in the high-speed operation region becomes higher than acceleration in the normal operation region. However, the discharge valve 32, the first hydraulic pump 2, and the recovery valve 44 may be controlled such that the slope of the total discharge rate of the boom cylinder 1 to the lever operation amount becomes constant throughout the operation region of the lever operation. In other words, control may be performed such that acceleration of the boom cylinder 1 becomes constant throughout the operation region. Accordingly, operability of the boom cylinder 1 improves.

According to the example presented in the embodiments described above, the pump delivery volume determination section 59 determines whether or not the pump delivery volume of the first hydraulic pump 2 is the maximum on the basis of the tilting angle detection signal of the tilting angle sensor 53. However, for example, the pump delivery volume of the first hydraulic pump 2 may be calculated based on an operation signal of the operation lever device 54, and whether or not a result of this calculation is the maximum pump delivery volume of the first hydraulic pump 2 may be determined.

According to the example presented in the embodiments described above, the pump regeneration amount determination section 60 calculates the regeneration amount of the first hydraulic pump 2 on the basis of the pressure detection signals of the first pressure sensor 51 and the second pressure sensor 52 and the tilting angle detection signal of the tilting angle sensor 53. However, for example, the pump delivery volume of the first hydraulic pump 2 may be calculated based on an operation signal of the operation lever device 54, and the regeneration amount of the first hydraulic pump 2 may be calculated based on a result of this calculation and the pressure detection signals of the first pressure sensor 51 and the second pressure sensor 52.

According to the example presented in the embodiments described above, the discharge flow path 16 is connected to the first flow path 11 of the hydraulic closed circuit via the third flow path 13. However, the discharge flow path 16 may be directly connected to the first flow path 11. In this case, the third flow path 13 only functions as a supply flow path.

1: Boom cylinder (Hydraulic cylinder)
1*e*: Cap chamber (First hydraulic working oil chamber)
1*f*: Rod chamber (Second hydraulic working oil chamber)
2: First hydraulic pump (Hydraulic pump)
2*a*: First port
2*b*: Second port
11: First flow path
12: Second flow path
13: Third flow path
16: Discharge flow path
29: Recovery flow path
32: Discharge valve
44: Recovery valve
54: Operation lever device (Operation device)
56, 56A, 56B: Controller
100: Hydraulic excavator (Construction machine)
112: Arm cylinder (Hydraulic cylinder)
113: Bucket cylinder (Hydraulic cylinder)

The invention claimed is:

1. A construction machine comprising:

a hydraulic pump that is of bidirectional delivery type and bidirectional variable displacement type, and has a first port and a second port;

a hydraulic cylinder that has a first hydraulic working oil chamber and a second hydraulic working oil chamber, and performs a pulling action in a case of discharge of hydraulic working oil from the first hydraulic working oil chamber, and a pushing action in the case of discharge of hydraulic working oil from the second hydraulic working oil chamber;

a first flow path that connects the first port of the hydraulic pump and the first hydraulic working oil chamber of the hydraulic cylinder;

a second flow path that connects the second port of the hydraulic pump and the second hydraulic working oil chamber of the hydraulic cylinder;

a discharge flow path branched from the first flow path;

a discharge valve that is disposed in the discharge flow path, and controls a flow rate of hydraulic working oil discharged from the first hydraulic working oil chamber of the hydraulic cylinder to the discharge flow path;

an operation device that issues an instruction for an action of the hydraulic cylinder; and a controller that controls the hydraulic pump and the discharge valve on a basis of the instruction of the operation device, wherein the controller controls the hydraulic pump and the discharge valve such that at least a part of hydraulic working oil discharged from the first hydraulic working oil chamber of the hydraulic cylinder is discharged to the discharge flow path in accordance with an operation amount of the operation device when the operation amount of the operation device lies within a fine operation region during the pulling action of the hydraulic cylinder in a state that an external load is applied in a contraction direction of the hydraulic cylinder, and the controller controls the hydraulic pump and the discharge valve such that an entire amount of hydraulic working oil discharged from the first hydraulic working oil chamber of the hydraulic cylinder is discharged to the discharge flow path when the operation amount lies in any range of the fine operation region.

2. A construction machine comprising:

a hydraulic pump that is of bidirectional delivery type and bidirectional variable displacement type, and has a first port and a second port;

a hydraulic cylinder that has a first hydraulic working oil chamber and a second hydraulic working oil chamber, and performs a pulling action in a case of discharge of hydraulic working oil from the first hydraulic working oil chamber, and a pushing action in the case of discharge of hydraulic working oil from the second hydraulic working oil chamber;

a first flow path that connects the first port of the hydraulic pump and the first hydraulic working oil chamber of the hydraulic cylinder;

a second flow path that connects the second port of the hydraulic pump and the second hydraulic working oil chamber of the hydraulic cylinder;

a discharge flow path branched from the first flow path;

a discharge valve that is disposed in the discharge flow path, and controls a flow rate of hydraulic working oil discharged from the first hydraulic working oil chamber of the hydraulic cylinder to the discharge flow path;

an operation device that issues an instruction for an action of the hydraulic cylinder; and a controller that controls the hydraulic pump and the discharge valve on a basis of the instruction of the operation device, wherein the controller controls the hydraulic pump and the discharge valve such that at least a part of hydraulic working oil discharged from the first hydraulic working oil chamber of the hydraulic cylinder is discharged to the discharge flow path in accordance with an operation amount of the operation device when the operation amount of the operation device lies within a fine operation region during the pulling action of the hydraulic cylinder in a state that an external load is applied in a contraction direction of the hydraulic cylinder, and the controller controls the hydraulic pump and the discharge valve such that an entire amount of hydraulic working oil discharged from the first hydraulic working oil chamber of the hydraulic cylinder is discharged to the discharge flow path when the operation amount lies in an initial range of the fine operation region, and the controller controls the hydraulic pump and the discharge valve such that a part of hydraulic working oil discharged from the first hydraulic working oil chamber of the hydraulic cylinder is discharged to the discharge flow path and remained hydraulic working oil is discharged toward a first port side of the hydraulic pump when the operation amount lies in a region exceeding the initial range within the fine operation region.

3. A construction machine comprising:

a hydraulic pump that is of bidirectional delivery type and bidirectional variable displacement type, and has a first port and a second port;

a hydraulic cylinder that has a first hydraulic working oil chamber and a second hydraulic working oil chamber, and performs a pulling action in a case of discharge of hydraulic working oil from the first hydraulic working oil chamber, and a pushing action in the case of discharge of hydraulic working oil from the second hydraulic working oil chamber;

a first flow path that connects the first port of the hydraulic pump and the first hydraulic working oil chamber of the hydraulic cylinder;

a second flow path that connects the second port of the hydraulic pump and the second hydraulic working oil chamber of the hydraulic cylinder;

a discharge flow path branched from the first flow path;

a discharge valve that is disposed in the discharge flow path, and controls a flow rate of hydraulic working oil discharged from the first hydraulic working oil chamber of the hydraulic cylinder to the discharge flow path;

an operation device that issues an instruction for an action of the hydraulic cylinder;

a controller that controls the hydraulic pump and the discharge valve on a basis of the instruction of the operation device;

a recovery flow path that connects the first flow path and the second flow path; and a recovery valve that is disposed in the recovery flow path, and controls a flow rate of hydraulic working oil flowing in the recovery flow path, wherein the controller controls the hydraulic pump and the discharge valve such that at least a part of hydraulic working oil discharged from the first hydraulic working oil chamber of the hydraulic cylinder is discharged to the discharge flow path in accordance with an operation amount of the operation device when the operation amount of the operation device lies within a fine operation region during the pulling action of the hydraulic cylinder in a state that an external load is applied in a contraction direction of the hydraulic cylinder, and the controller controls the hydraulic pump and the discharge valve such that a part of hydraulic working oil discharged from the first hydraulic working oil chamber of the hydraulic cylinder is discharged to the discharge flow path and a first port side of the hydraulic pump, and controls the recovery valve such that remained hydraulic working oil is supplied to the second hydraulic working oil chamber of the hydraulic cylinder via the recovery flow path when a pump delivery volume or a regeneration amount of the hydraulic pump reaches a predetermined condition during the pulling action of the hydraulic cylinder in the state that the external load is applied in the contraction direction of the hydraulic cylinder.

* * * * *